US006853384B2

(12) United States Patent
Miyata et al.

(10) Patent No.: US 6,853,384 B2
(45) Date of Patent: Feb. 8, 2005

(54) LIQUID CRYSTAL DISPLAY DEVICE AND DRIVING METHOD THEREOF

(75) Inventors: Hidekazu Miyata, Nagoya (JP); Makoto Shiomi, Tenri (JP); Akihito Jinda, Kitakatsuragi-gun (JP); Kazunari Tomizawa, Soraku-gun (JP); Koichi Miyachi, Soraku-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 392 days.

(21) Appl. No.: 09/954,288

(22) Filed: Sep. 17, 2001

(65) Prior Publication Data

US 2002/0033789 A1 Mar. 21, 2002

(30) Foreign Application Priority Data

Sep. 19, 2000 (JP) ..... 2000-284267
May 18, 2001 (JP) ..... 2001-150169
Jun. 8, 2001 (JP) ..... 2001-174845

(51) Int. Cl.[7] ..... G09G 5/02

(52) U.S. Cl. ..... 345/601; 345/602; 345/605; 345/87; 345/94

(58) Field of Search ..... 345/87, 100, 90, 345/94, 95, 98, 99, 605, 610, 209, 601, 602

(56) References Cited

U.S. PATENT DOCUMENTS 5,495,265 A * 2/1996 Hartman et al. ..... 345/87
5,936,602 A * 8/1999 Tsuchida et al. ..... 345/99
6,091,389 A * 7/2000 Maeda et al. ..... 345/98
6,373,497 B1 * 4/2002 McKnight et al. ..... 345/602
6,501,451 B1 * 12/2002 Sakashita ..... 345/87

FOREIGN PATENT DOCUMENTS

| | | |
|---|---|---|
| JP | 01010299 A | 1/1989 |
| JP | 04288589 A | 10/1992 |
| JP | 07-056532 | 3/1995 |
| JP | 07-104715 | 4/1995 |
| JP | 07-129133 | 5/1995 |
| JP | 10-039837 | 2/1998 |

OTHER PUBLICATIONS

See Korean Patent Office Action and translation.

* cited by examiner

*Primary Examiner*—Richard Hjerpe
*Assistant Examiner*—Peter Prizio
(74) *Attorney, Agent, or Firm*—Harness, Dickey & Pierce P.L.C.

(57) ABSTRACT

A liquid crystal display device carries out tone display with pixels by applying a tone voltage according to tone data to each pixel in each frame, and includes: an LUT memory, which receives tone data of a display frame and tone data of an immediately preceding frame, for converting and outputting the tone data of the display frame; a source driver for applying the tone voltage to the pixels based on the converted tone data outputted from the LUT memory; and a liquid crystal cell, which makes up the pixels, for realizing tone display by the applied tone voltage, wherein the LUT memory stores beforehand output tone data which is specified by the tone data of the display frame and the tone data of the immediately preceding frame. This reduces a voltage change of pixel electrodes which is associated with a tone change to suppress unmatched tone display, thereby improving image quality of moving images.

10 Claims, 34 Drawing Sheets

FIG. 9

| | | DISPLAY FRAME TONE DATA | | | | | | | | |
|---|---|---|---|---|---|---|---|---|---|---|
| | | 0 | 32 | 64 | 96 | 128 | 160 | 192 | 224 | 255 |
| PRECEDING FRAME TONE DATA | 0 | 128 | 168 | 208 | 252 | 290 | 332 | 365 | 389 | 391 |
| | 32 | 127 | 160 | 203 | 246 | 285 | 327 | 361 | 389 | 391 |
| | 64 | 127 | 154 | 192 | 237 | 276 | 318 | 355 | 386 | 391 |
| | 96 | 126 | 149 | 184 | 224 | 267 | 309 | 347 | 382 | 390 |
| | 128 | 125 | 145 | 178 | 216 | 256 | 301 | 341 | 379 | 390 |
| | 160 | 124 | 140 | 172 | 209 | 247 | 288 | 333 | 373 | 390 |
| | 192 | 123 | 130 | 164 | 199 | 235 | 277 | 320 | 367 | 389 |
| | 224 | 121 | 127 | 153 | 187 | 221 | 262 | 305 | 352 | 389 |
| | 255 | 120 | 125 | 142 | 171 | 202 | 241 | 283 | 335 | 383 |

FIG. 10

| | | DISPLAY FRAME TONE DATA | | | | | | | | |
|---|---|---|---|---|---|---|---|---|---|---|
| | | 0 | 32 | 64 | 96 | 128 | 160 | 192 | 224 | 255 |
| PRECEDING FRAME TONE DATA | 0 | 128 | 168 | 208 | 252 | 295 | 335 | 371 | 389 | 391 |
| | 32 | 127 | 160 | 203 | 246 | 285 | 332 | 369 | 389 | 391 |
| | 64 | 127 | 154 | 192 | 237 | 276 | 318 | 365 | 386 | 391 |
| | 96 | 126 | 149 | 184 | 224 | 267 | 309 | 347 | 382 | 390 |
| | 128 | 125 | 145 | 178 | 216 | 256 | 301 | 341 | 379 | 390 |
| | 160 | 124 | 140 | 172 | 209 | 247 | 288 | 333 | 373 | 390 |
| | 192 | 123 | 130 | 164 | 199 | 235 | 277 | 320 | 367 | 389 |
| | 224 | 121 | 127 | 153 | 187 | 221 | 262 | 305 | 352 | 389 |
| | 255 | 120 | 125 | 142 | 171 | 202 | 241 | 283 | 335 | 383 |

FIG. 11

| | | DISPLAY FRAME TONE DATA | | | | | | | | |
|---|---|---|---|---|---|---|---|---|---|---|
| | | 0 | 32 | 64 | 96 | 128 | 160 | 192 | 224 | 255 |
| PRECEDING FRAME TONE DATA | 0 | 0 | 40 | 80 | 124 | 167 | 207 | 243 | 255 | 255 |
| | 32 | 0 | 32 | 75 | 118 | 157 | 204 | 241 | 255 | 255 |
| | 64 | 0 | 26 | 64 | 109 | 148 | 190 | 237 | 255 | 255 |
| | 96 | 0 | 21 | 56 | 96 | 139 | 181 | 219 | 254 | 255 |
| | 128 | 0 | 17 | 50 | 88 | 128 | 173 | 213 | 251 | 255 |
| | 160 | 0 | 12 | 44 | 81 | 119 | 160 | 205 | 245 | 255 |
| | 192 | 0 | 2 | 36 | 71 | 107 | 149 | 192 | 239 | 255 |
| | 224 | 0 | 0 | 25 | 59 | 93 | 134 | 177 | 224 | 255 |
| | 255 | 0 | 0 | 14 | 43 | 74 | 113 | 155 | 207 | 255 |

FIG. 17

| | | DISPLAY FRAME TONE DATA | | | | | | | |
|---|---|---|---|---|---|---|---|---|---|
| | | 83 | 84 | 85 | 86 | 87 | 88 | 89 | 90 |
| PRECEDING FRAME TONE DATA | 244 | 22 | 23 | 23 | 24 | 25 | 26 | 27 | 29 |
| | 245 | 21 | 22 | 23 | 24 | 24 | 25 | 26 | 28 |
| | 246 | 20 | 22 | 22 | 23 | 24 | 24 | 25 | 28 |
| | 247 | 20 | 21 | 22 | 23 | 23 | 24 | 25 | 27 |
| | 248 | 19 | 20 | 21 | 22 | 23 | 23 | 24 | 26 |
| | 249 | 17 | 18 | 19 | 20 | 21 | 22 | 23 | 25 |
| | 250 | 0 | 0 | 3 | 5 | 6 | 7 | 8 | 12 |
| | 251 | 0 | 0 | 0 | 0 | 1 | 4 | 5 | 8 |
| | 252 | 0 | 0 | 0 | 0 | 0 | 0 | 0 | 5 |
| | 253 | 0 | 0 | 0 | 0 | 0 | 0 | 0 | 0 |
| | 254 | 0 | 0 | 0 | 0 | 0 | 0 | 0 | 0 |
| | 255 | 0 | 0 | 0 | 0 | 0 | 0 | 0 | 0 |

FIG. 18

| | | DISPLAY FRAME TONE DATA | | | | | | | |
|---|---|---|---|---|---|---|---|---|---|
| | | 83 | 84 | 85 | 86 | 87 | 88 | 89 | 90 |
| PRECEDING FRAME TONE DATA | 244 | 21 | 23 | 24 | 25 | 26 | 26 | 27 | 28 |
| | 245 | 21 | 23 | 24 | 25 | 26 | 26 | 27 | 28 |
| | 246 | 21 | 23 | 24 | 25 | 26 | 26 | 27 | 28 |
| | 247 | 21 | 23 | 24 | 25 | 26 | 26 | 27 | 28 |
| | 248 | 19 | 20 | 21 | 22 | 23 | 23 | 24 | 25 |
| | 249 | 19 | 20 | 21 | 22 | 23 | 23 | 24 | 25 |
| | 250 | 19 | 20 | 21 | 22 | 23 | 23 | 24 | 25 |
| | 251 | 19 | 20 | 21 | 22 | 23 | 23 | 24 | 25 |
| | 252 | 3 | 0 | 1 | 2 | 3 | 0 | 1 | 2 |
| | 253 | 3 | 0 | 1 | 2 | 3 | 0 | 1 | 2 |
| | 254 | 3 | 0 | 1 | 2 | 3 | 0 | 1 | 2 |
| | 255 | 3 | 0 | 1 | 2 | 3 | 0 | 1 | 2 |

FIG. 23

| DISPLAY FRAME TONE DATA m | NUMERICAL DATA Am |
|---|---|
| 0 | 964 |
| 1 | 963 |
| 2 | 962 |
| ⋮ | ⋮ |
| 254 | 223 |
| 255 | 219 |

FIG. 24

| DISPLAY FRAME TONE DATA n | NUMERICAL DATA Bn |
|---|---|
| 0 | 0 |
| 1 | 1 |
| 2 | 2 |
| ⋮ | ⋮ |
| 254 | 2391 |
| 255 | 2403 |

FIG. 25

| NUMERICAL DATA Dp | TONE DATA P |
|---|---|
| 0 | 255 |
| 1 | 255 |
| 2 | 255 |
| ⋮ | ⋮ |
| 14514 | 255 |
| 14515 | 254 |
| ⋮ | ⋮ |
| 46875 | 254 |
| ⋮ | ⋮ |
| 3581537 | 1 |
| ⋮ | ⋮ |
| 3586098 | 1 |
| 3586097 | 0 |
| ⋮ | ⋮ |
| 6431127 | 0 |

FIG. 34

| | | BIT | | | | | | | |
|---|---|---|---|---|---|---|---|---|---|
| | | 7 | 6 | 5 | 4 | 3 | 2 | 1 | 0 |
| TONE | 0 | 0 | 0 | 0 | 0 | 0 | 0 | 0 | 0 |
| | 255 | 1 | 1 | 1 | 1 | 1 | 1 | 1 | 1 |
| | 240 | 1 | 1 | 1 | 1 | 0 | 0 | 0 | 0 |
| | 255 | 1 | 1 | 1 | 1 | 1 | 1 | 1 | 1 |
| | 31 | 0 | 0 | 0 | 1 | 1 | 1 | 1 | 1 |
| | 16 | 0 | 0 | 0 | 1 | 0 | 0 | 0 | 0 |

FIG. 36

| BIT | 7 | 6 | 5 | 4 | 3 | 2 | 1 | 0 |
|---|---|---|---|---|---|---|---|---|
| ① | $A_7$ | $B_6$ | $C_5$ | $D_4$ | $E_3$ | $F_2$ | $G_1$ | $H_0$ |
| ② | — | — | $0_5$ | $D_4$ | $E_3$ | $F_2$ | $G_1$ | $H_0$ |
| ③ | — | — | $1_5$ | $A_4$ | $B_3$ | $C_2$ | $D_1$ | $E_0$ |

FIG. 37

| BIT | 7 | 6 | 5 | 4 | 3 | 2 | 1 | 0 |
|---|---|---|---|---|---|---|---|---|
| ④ | $a_7$ | $b_6$ | $c_5$ | $d_4$ | $e_3$ | $f_2$ | $g_1$ | $h_0$ |
| ⑤ | — | — | $FL_5$ | $v_4$ | $w_3$ | $x_2$ | $y_1$ | $z_0$ |
| ⑥ | $0_7$ | $0_6$ | $0_5$ | $v_4$ | $w_3$ | $x_2$ | $y_1$ | $z_0$ |
| ⑦ | $v_7$ | $w_6$ | $x_5$ | $y_4$ | $z_3$ | $f_2$ | $g_1$ | $h_0$ |

FIG. 38

<table>
<tr><td colspan="2" rowspan="2"></td><td>DISPLAY FRAME TONE DATA</td></tr>
<tr><td>6 BIT DATA</td></tr>
<tr><td>PRECEDING FRAME TONE DATA</td><td>6 BIT DATA</td><td>6 BIT DATA</td></tr>
</table>

FIG. 39

| BIT | 7 | 6 | 5 | 4 | 3 | 2 | 1 | 0 |
|---|---|---|---|---|---|---|---|---|
| ① | $A_7$ | $B_6$ | $C_5$ | $D_4$ | $E_3$ | $F_2$ | $G_1$ | $H_0$ |
| ②' | — | — | $0_5$ | $C_4$ | $D_3$ | $E_2$ | $F_1$ | $G_0$ |
| ③ | — | — | $1_5$ | $A_4$ | $B_3$ | $C_2$ | $D_1$ | $E_0$ |

FIG. 41

| POINT | CRITERIA OF EVALUATION |
|---|---|
| 5 | EDGE BLUR UNRECOGNIZABLE |
| 4 | EDGE BLUR RECOGNIZABLE BUT NOT NOTICEABLE |
| 3 | EDGE BLUR NOTICEABLE BUT NOT PROMINENT |
| 2 | EDGE BLUR PROMINENT |
| 1 | EDGE BLUR TOO PROMINENT |

FIG. 42

| NUMBER | DISPLAY TYPE | GAIN/LOSS OF LUMINANCE | RESULT OF EVALUATION |
|---|---|---|---|
| 1 | 20-INCH LIQUID CRYSTAL TELEVISION 1 | −30%～−20% | 2.4 |
| 2 | 20-INCH LIQUID CRYSTAL TELEVISION 2 | −20%～−10% | 2.8 |
| 3 | 20-INCH LIQUID CRYSTAL TELEVISION 3 | −10%～ −5% | 3.3 |
| 4 | 20-INCH LIQUID CRYSTAL TELEVISION 4 | −5%～ 0% | 3.8 |
| 5 | 20-INCH CRT | 0% | 5.0 |
| 6 | 20-INCH LIQUID CRYSTAL TELEVISION 5 | 0%～ 5% | 3.9 |
| 7 | 20-INCH LIQUID CRYSTAL TELEVISION 6 | 5%～ 10% | 3.5 |
| 8 | 20-INCH LIQUID CRYSTAL TELEVISION 7 | 10%～ 20% | 2.7 |
| 9 | 20-INCH LIQUID CRYSTAL TELEVISION 8 | 20%～ 30% | 2.2 |

FIG. 43

| TONE | LUMINANCE (%) |
|---|---|
| 0 | 0.00 |
| 16 | 0.23 |
| 31 | 0.97 |
| 240 | 87.51 |
| 255 | 100.00 |

LIQUID CRYSTAL DISPLAY DEVICE AND DRIVING METHOD THEREOF

FIELD OF THE INVENTION

The present invention relates to a liquid crystal display device which is capable of tone display and a driving method of such a liquid crystal display device.

BACKGROUND OF THE INVENTION

FIG. 14 is a schematic drawing showing a structure of a liquid crystal display device including a liquid crystal panel 10 of the active-matrix variety with thin-film transistors ("TFT" hereinafter) as the switching element, and drivers (source driver 12, gate driver 14) for driving the liquid crystal panel 10. The liquid crystal panel 10 includes a plurality of source bus lines 16 which are disposed parallel to one another in a vertical direction of the screen, and a plurality of scanning lines 18 which are disposed parallel to one another in a horizontal direction of the screen. Outside of the liquid crystal panel 10, the source bus lines 16 are connected to the source driver 12, and the scanning lines 18 are connected to the gate driver 14. The source bus lines 16 and the gate bus lines 18 are substantially orthogonal to one another, and areas corresponding to intersections of the source bus lines 16 and the gate bus lines 18 make up pixels. Each pixel includes a TFT 20 and a liquid crystal cell 22.

In order to display an image on the liquid crystal panel 10, the source driver 12 applies tone voltages according to tone data (image data) of their respective scanning lines 18 to the corresponding pixels of the scanning lines 18, while the gate driver 14 successively switches ON TFTs 20 of the respective the scanning lines 18.

FIG. 15 is a circuit diagram showing an equivalent circuit of a pixel in the liquid crystal panel 10 of FIG. 14. The liquid crystal cell 22 is connected to the drain of the TFT 20 and to a common electrode 26 which is common to all pixels. Further, though not shown in FIG. 14, the pixel has a load capacitor 24. The load capacitor 24 is connected to the drain of the TFT 20 and to a load capacitor electrode 28 which is common to all pixels.

To activate the pixels, a tone voltage according to tone data is applied to the liquid crystal cell 22 from the source bus line 16 while the TFT 20 is ON. The tone voltage, which is set according to tone data, is applied to each pixel according to the tone data for every frame. In response to an applied voltage, the liquid crystal molecules in the liquid crystal cell 22 undergo changes by their dielectric anisotropic property to change directions of a long axis (director). Since the liquid crystal molecules are optically anisotropic, a change in direction of the director causes a change in polarization direction of light which travels through the liquid crystal cell 22. The quantity of light through the liquid crystal cell 22 is controlled by tone voltages applied to the liquid crystal cell 22 with the aid of other members of the liquid crystal cell 22, such as polarizers. The luminance of pixels is so controlled to attain desired tone luminance to be displayed, thus displaying images.

The tone voltage applied to the liquid crystal cell 22 is also applied to the load capacitor 24. The load capacitor 24 stores charge according to the applied tone voltage. The charge stored in the load capacitor 24 is maintained therein even after the TFT 20 is switched OFF (gate OFF) until the tone voltage is applied again in the next frame. In this way, the tone voltage applied to the liquid crystal cell 22 remains over one frame period.

In changing tone luminance of pixels between frames, the direction of the director of the liquid crystal molecules displaying the tone luminance of the frame before the change is changed with application of a tone voltage to the pixels of the next frame. This brings about a change in optical characteristics of the pixels, thereby changing tone luminance of the pixels.

Incidentally, it takes some time for the liquid crystal molecules to respond to a change in tone voltage. For example, the response speed of nematic liquid crystal is on the order of several ms to several ten ms depending on display modes. This means that the response of the liquid crystal molecules does not complete at the OFF of the TFT 20, and the director keeps changing even after the TFT 20 is switched OFF.

Here, the liquid crystal molecules has a dielectric anisotropic property, and a change in director of the liquid crystal molecules inevitably changes the dielectric constant of liquid crystal in the liquid crystal cell 22, which in turn changes the capacitance (electric capacitance) across electrodes of the liquid crystal cell 22. As noted above, the director of the liquid crystal molecules keeps changing even after the TFT 20 is switched OFF, while supply of charge to the liquid crystal cell 22 and the load capacitor 24 is stopped at the OFF of the TFT 20. Thus, a change in capacitance of the liquid crystal cell 22 after OFF of the TFT 20 causes a voltage change across the electrodes of the liquid crystal cell 22. That is, the voltage of the liquid crystal cell 22 becomes different from the tone voltage which was applied while the TFT 20 was ON after the TFT 20 was switched OFF.

Thus, despite the characteristics of the liquid crystal molecules which can respond within one frame, there are cases where the tone luminance obtained may become different from that desired for display due to the voltage of the liquid crystal cell 22 which changes within one frame. Conversely, in order to obtain desired tone luminance, there are cases where the same voltage needs to be applied over several frames (e.g., 3 frames).

Note that, a technique for correcting the slow response of liquid crystal molecules in response to an applied voltage is disclosed, for example, in Japanese Unexamined Patent Publication No. 10299/1989 (Tokukaisho 64-10299) (published date: Jan. 13, 1989). However, the technique disclosed in this publication incorporates a correction circuit in the device to predict data every time it is outputted. This requires a complex structure for the correction circuit and poses the problem of slow processing speed. Further, the data inputted to the correction circuit include data which was corrected immediately before in the correction circuit and stored in a memory. In other words, the corrected data is used to further correct the next data. This requires a complex device structure. Further, a technique such as that disclosed in the foregoing publication does not take into consideration the foregoing drawbacks caused by the capacitance change of the liquid crystal cell 22, and the foregoing publication does not teach a specific method of converting the data to solve these drawbacks.

SUMMARY OF THE INVENTION

The present invention was made in view of the foregoing problems and an object of the present invention is to improve, with a simple device structure and a fast processing speed, image quality of displayed moving images by improving an apparent response speed of liquid crystal molecules by way of suppressing a mismatch in tone display by reducing a voltage change of pixel electrodes associated with a tone change of liquid crystal display elements.

In order to achieve the foregoing object, a liquid crystal display device of the present invention carries out tone display with pixels by applying a tone voltage according to tone data to each pixel in each frame, and includes:: a converter, which receives tone data of a display frame and tone data of an immediately preceding frame, for converting and outputting the tone data of the display frame; a driver for applying the tone voltage to the pixels based on the converted tone data outputted from the converter; and a liquid crystal cell, which makes up the pixels, for realizing tone display by the applied tone voltage, wherein the converter stores beforehand output tone data which is specified by the tone data of the display frame and the tone data of the immediately preceding frame.

According to this arrangement, the converter outputs predetermined tone data which is specified by tone data of the display frame and tone data of the immediately preceding frame, and a tone voltage according to this tone data is applied to the pixels. Thus, the tone voltage applied to the pixels take into account the influence of capacitive (electric capacitance) change of the liquid crystal cell between the display frame and the immediately preceding frame. This enables correction of a mismatch in tone display which is caused by the capacitive change of the liquid crystal cell, thus realizing display which accurately reproduces inputted tone data in display of moving images in particular.

In order to achieve the foregoing object, a liquid crystal display device of the present invention carries out tone display with pixels by applying a tone voltage according to tone data to each pixel in each frame, and includes: a converter for converting tone data of a display frame to correction tone data based on the tone data of the display frame and tone data of an immediately preceding frame; a driver for applying the tone voltage to the pixels based on the correction tone data obtained in the converter; and a liquid crystal cell, which makes up the pixels, for realizing tone display by the applied tone voltage, wherein the converter stores beforehand defined tone data which is specified by the tone data of the display frame and the tone data of the immediately preceding frame, and the converter generates the correction tone data based on the specified defined tone data.

In this manner, instead of directly storing the tone data to be converted and outputted, the converter may be adapted to output tone data stored therein after simple calculations.

In order to achieve the foregoing object, a liquid crystal display device of the present invention carries out tone display with pixels by applying a tone voltage according to tone data to each pixel in each frame, and includes: a converter for converting tone data of a display frame to correction tone data based on the tone data of the display frame and tone data of an immediately preceding frame; a driver for applying the tone voltage to the pixels based on the correction tone data obtained in the converter; and a liquid crystal cell, which makes up the pixels, for realizing tone display by the applied tone voltage, wherein: the converter stores beforehand a first conversion value which corresponds the tone data of the display frame and a second conversion value which corresponds to the tone data of the immediately preceding frame, and the converter generates the correction tone data based on a result of calculation using the first conversion value and the second conversion value corresponding to the tone data of the display frame and the tone data of the immediately preceding frame, respectively.

According to this arrangement, in the process of generating the correction tone data from the tone data of the display frame and the tone data of the immediately preceding frame, those processes which require complex calculations are carried out by the conversion into the pre-stored first conversion value and second conversion value, and those which can be carried out by simple calculations are performed by calculations. Thus, calculations, which become complex if all processes are carried out by calculations, do not become complex, and the structure of the converter can be made simpler. Further, unlike the case where conversion values are stored for each case, no large space is required for the memory space and the converter can be simplified.

In order to achieve the foregoing object, a liquid crystal display device of the present invention carries out tone display with pixels by applying a tone voltage according to tone data to each pixel in each frame, and includes: a converter for converting tone data of a display frame to correction tone data based on the tone data of the display frame and tone data of an immediately preceding frame; a driver for applying the tone voltage to the pixels based on the correction tone data obtained in the converter; and a liquid crystal cell, which makes up the pixels, for realizing tone display by the applied tone voltage, wherein: the converter stores beforehand a first reference value for calculating the first conversion value which corresponds to the tone data of the display frame and a second reference value for calculating the second conversion value which corresponds to the tone data of the immediately preceding frame, and the converter calculates the first conversion value and the second conversion value by interpolation based on the first reference value and the second reference value, respectively, and generates the correction tone data based on a result of calculation using the first conversion value and the second conversion value corresponding to the tone data of the display frame and the tone data of the immediately preceding frame, respectively.

According to this arrangement, it is not required to store first and second conversion values which correspond to all tones, and thus less memory space is required for the converter. Further, since interpolation can be performed by relatively simple calculations, the converter can be realized by a relatively simple circuit structure. Thus, the circuit structure of the converter does not become complex.

In order to achieve the foregoing object, a liquid crystal display device of the present invention carries out tone display with pixels by applying a tone voltage according to tone data to each pixel in each frame, ad includes: a converter for converting tone data of a display frame to correction tone data based on the tone data of the display frame and tone data of an immediately preceding frame; a digit converter for converting digits of the tone data of the display frame and the tone data of the immediately preceding frame; a driver for applying the tone voltage to the pixels based on the correction tone data obtained in the converter; and a liquid crystal cell, which makes up the pixels, for realizing tone display by the applied tone voltage, wherein: the digit converter carries out the conversion to decrease digits of tone data by deleting lower digits of the tone data when tones indicated by the tone data are on a lighter side of a predetermined threshold value, and by deleting upper digits of the tone data when tones indicated by the tone data is on a darker side of the predetermined threshold value, and the converter stores beforehand defined tone data which is specified by the tone data of the display frame and the tone data of the immediately preceding frame after the conversion by the digit converter, and generates the correction tone data based on the specified defined tone data.

According to this arrangement, as described above, the tone voltage applied to the pixels takes into account influence of capacitive change of the liquid crystal cell between the display frame and the immediately preceding frame, thus correcting a mismatch in tone display which is caused by the capacitive change of the liquid crystal cell.

Here, according to the foregoing arrangement, concerning the tone data of the display frame and the tone data of the immediately preceding frame, the digit converter converts tone data to delete a part of the tone data according to tones indicated by the tone data so that digits of the tone data are made smaller. Further, the converter stores beforehand defined tone data which is specified by the tone data of the display frame and the tone data of the immediately preceding frame after the conversion by the digit converter. By thus reducing the digit number of tone data to reduce the data volume, the data used to specify the defined tone data in the converter can be made smaller, thereby reducing the volume of defined tone data to be stored. As a result, the memory capacity for storing the defined tone data in the converter can be reduced.

Further, in conversion of digits of the tone data by the digit converter, lower digits are deleted when tones indicated by the tone data are on the brighter side of a predetermined value, and upper digits are deleted when tones indicated by the tone data are on the darker side of the predetermined value. This enables reducing digits of tone data while maintaining those parts of the tone data which are largely affected by the conversion by the converter, thus preventing lowering of display quality.

Further, a driving method of a liquid crystal display device of the present invention is for a liquid crystal display device which carries out tone display with pixels which includes a liquid crystal cell capable of tone display by an applied tone voltage, the liquid crystal display device realizing tone display by applying a tone voltage according to tone data to each pixel in each frame, wherein: the liquid crystal display device is driven to specify tone data from pre-stored tone data according to tone data of a display frame and tone data of an immediately preceding frame, and to realize tone display in the display frame by applying the tone voltage based on the specified tone data to the pixels, and the pre-stored tone data is set so that, when the pixels realizes tone display based on this tone data, luminance of a pixel after an elapsed time period which corresponds to one frame from application of the tone voltage to the pixel based on the tone data falls within a range of 90% to 110% of intended display luminance.

Use of tone data exceeding this range causes luminance of the frame displayed by the tone data to be perceived as being widely different from the target luminance, i.e., from the luminance which corresponds to the tone indicated by the tone data of the display frame, and it may cause abnormal display in the subsequent frames. The foregoing method can prevent such problems.

For a fuller understanding of the nature and advantages of the invention, reference should be made to the ensuing detailed description taken in conjunction with the accompanying drawings.

BRIEF DESCRIPTION OF THE DRAWINGS

FIG. 9 is a look-up table which is obtained based on FIG. 4, FIG. 5, and Equation (4).

FIG. 10 is an exemplary look-up table which is obtained by correcting the look-up table of FIG. 9.

FIG. 11 is an exemplary look-up table using a source driver which is incapable of outputting voltages in a range outside of a tone voltage range limited by black display and white display of the liquid crystal cell.

FIG. 17 is a table showing a portion of a look-up table which is set in an LUT memory of FIG. 1.

FIG. 18 is a table showing a portion of a look-up table which is set in the LUT memory of FIG. 16.

FIG. 23 is a table showing a relationship between display frame tone data and numerical data in the Third Embodiment of the present invention.

FIG. 24 is a table showing a relationship between preceding frame tone data and numerical data in the Third Embodiment of the present invention.

FIG. 25 is a table showing a relationship between numerical data and tone data in the Third Embodiment of the present invention.

FIG. 34 is a table showing a relationship between tone and bit.

FIG. 36 is a conceptual view showing contents of tone data in places indicated by ① through ③ in FIG. 35.

FIG. 37 is a conceptual view showing contents of tone data in places indicated by ④ through ⑦ in FIG. 35.

FIG. 38 is a conceptual view showing the number of inputs and outputs of the LUT memory of FIG. 35.

FIG. 39 is a conceptual view with modified content of the tone data of FIG. 36.

FIG. 41 is a table showing criteria of evaluation of the experiment for evaluating images.

FIG. 42 is a table showing types of displays used in the experiment for evaluating images, gain and loss of luminance which are set for each display, and results of evaluation.

FIG. 43 is a table showing a typical relationship between tone and luminance.

DESCRIPTION OF THE EMBODIMENTS

[First Embodiment]

Figure 1:
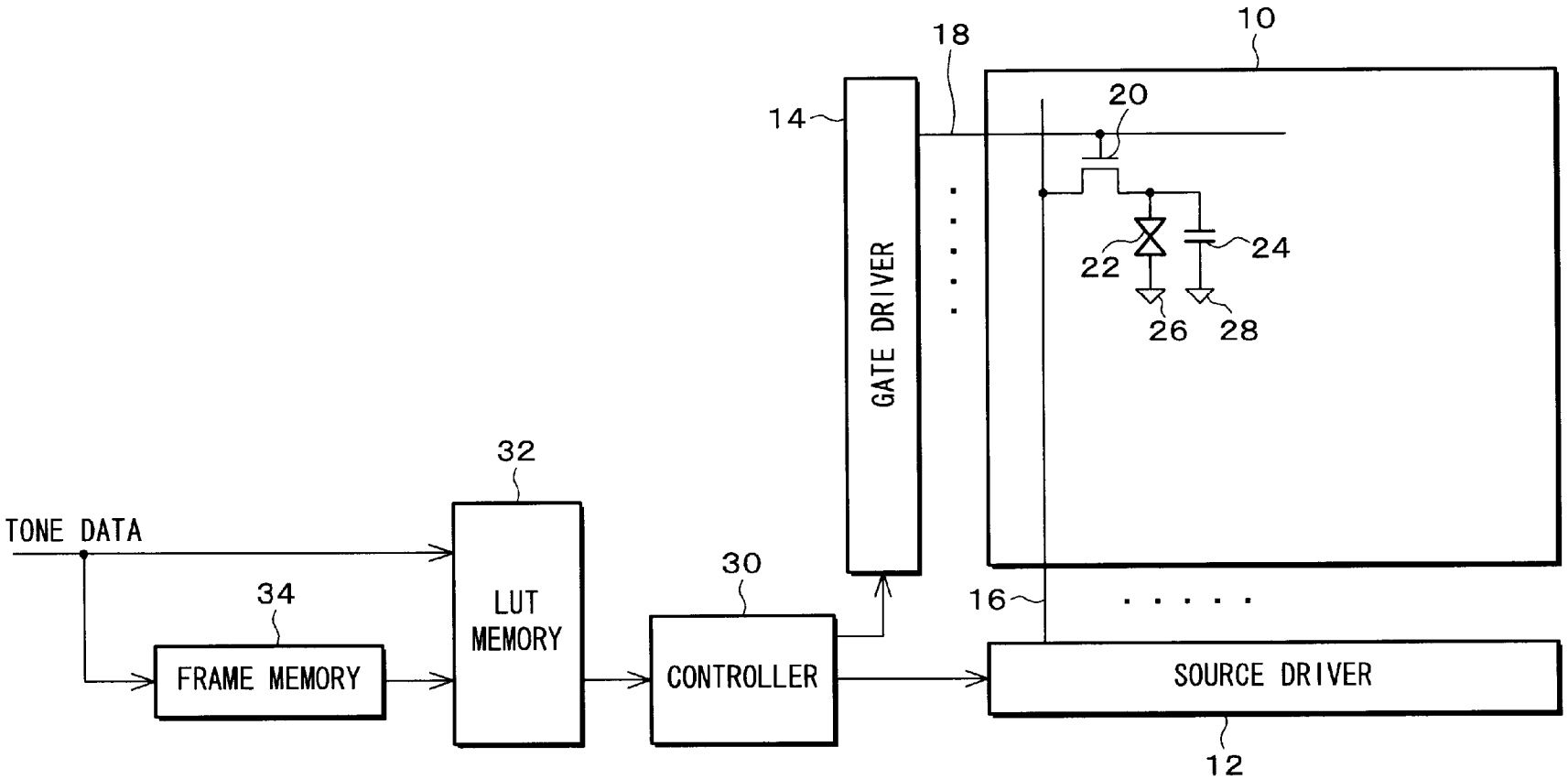
FIG. 1 is a block diagram showing a structure of a liquid crystal display device according to the First Embodiment of the present invention.
Figure 14:
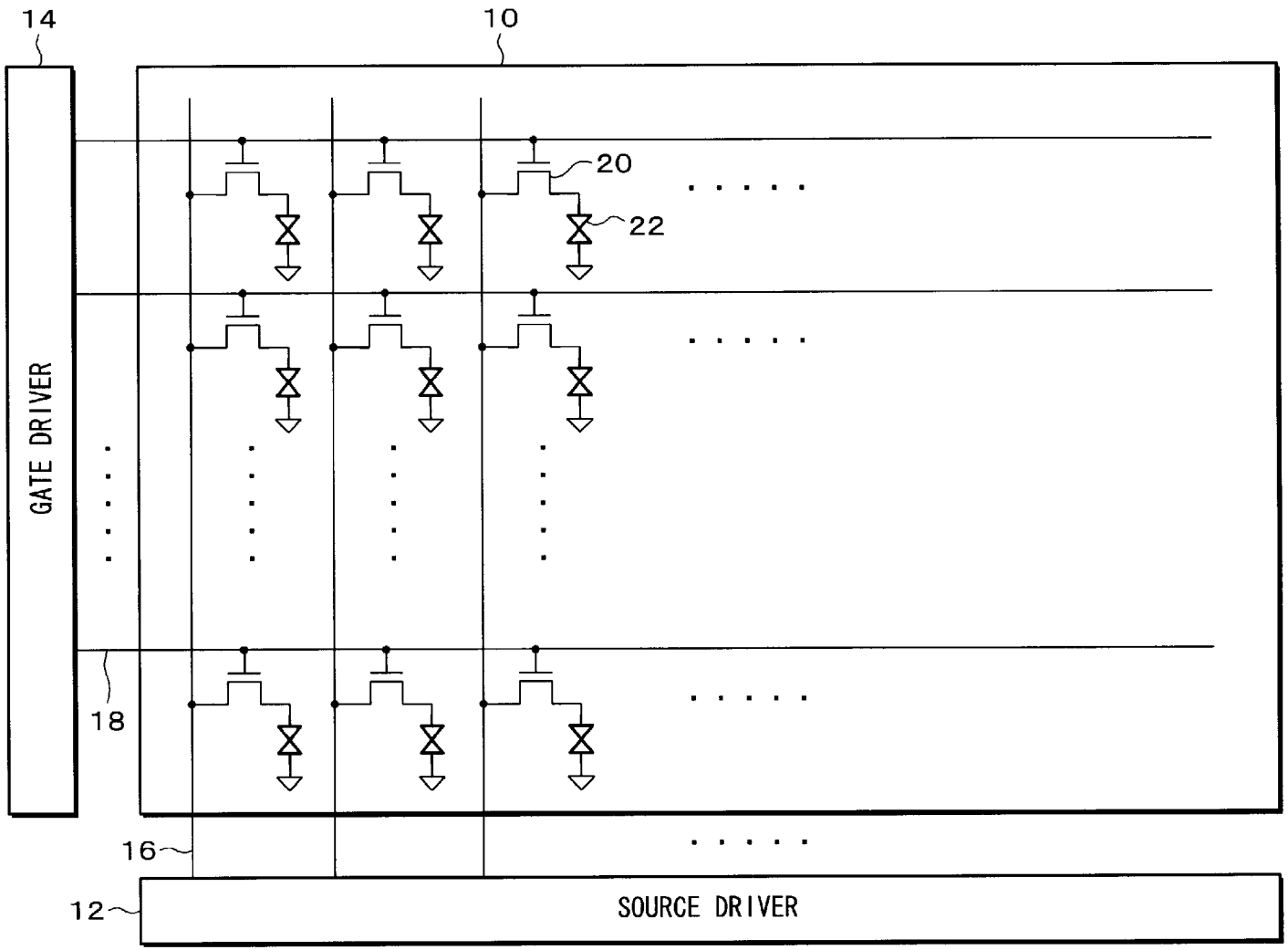
FIG. 14 is a schematic drawing showing a structure of a liquid crystal display device provided with an active-matrix liquid crystal panel having thin-film transistors as a switching element and drivers for driving the liquid crystal panel.
Figure 15:
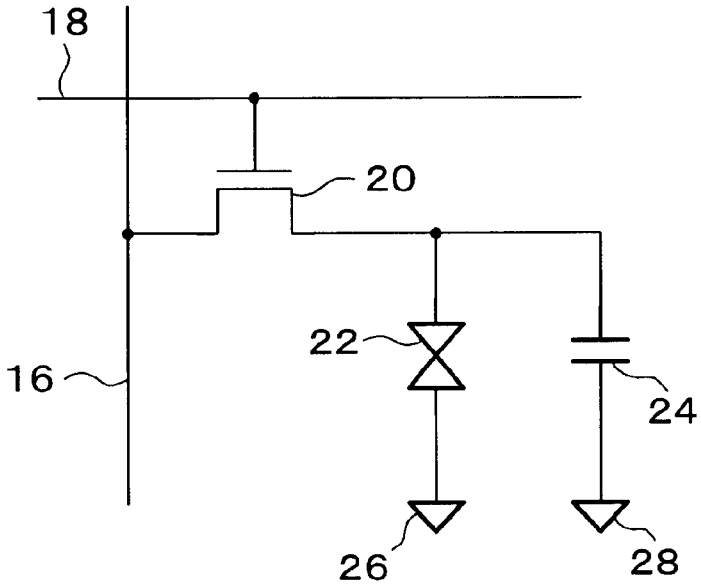
FIG. 15 is a circuit diagram showing an equivalent circuit of a pixel of the liquid crystal panel of FIG. 14.

The following describes one embodiment of the present invention with reference to FIG. 1 through FIG. 11. FIG. 1 is a block diagram showing a structure of an active-matrix liquid crystal display device (LCD) according to the present embodiment. Note that, in FIG. 1, elements such as a liquid crystal panel 10, a source driver (driver) 12, and a gate driver 14 are the same as those described with reference to FIG. 14 in the BACKGROUND OF THE INVENTION section, and they are simplified in FIG. 1. Also, elements having the same functions as those described in FIG. 14 and FIG. 15 are given the same reference numerals and explanations thereof are omitted here.

The source driver 12 and the gate driver 14 are controlled by a controller (LCD controller, gate array) 30. From the controller 30 to the source driver 12 is sent tone data (image data) for specifying a tone voltage to be applied to each pixel via source bus lines 16. Here, the tone data is digital data. Further, the controller 30 sends a signal for specifying a scanning timing to the gate driver 14, and a signal for switching and outputting the tone voltage in synchronism with the scanning timing to the source driver 12.

The tone data sent to the source driver 12 from the controller 30 is supplied to the controller 30 from a look-up table memory (converter, memory) 32 (hereinafter "LUT memory 32"), which is a memory provided with a look-up table (LUT) to be described later. The LUT memory 32 is made up of an SRAM and has two inputs. To one of the two inputs ("first input" hereinafter) is directly connected a data bus line for transferring the tone data, and to the other input ("second input" hereinafter) is connected a data bus line via a frame memory (memory section, frame delay circuit) 34.

Note that, even though the LUT memory 32 and the frame memory 34 are provided one each in the structure of FIG. 1, they may be provided independently for the respective tone data of RGB when the liquid crystal panel 10 is adapted to display colors of RGB and the tone data has the color data of RGB. Further, instead of the LUT memory 32, calculating elements such as an FPGA (Field-Programmable Gate Array) may be used.

The frame memory 34 is an FIFO (First-in First-out) memory which is capable of storing tone data of one frame. The frame memory 34 can therefore simultaneously process input and output of data. Further, by the provision of the frame memory 34, the tone data can be delayed by one frame with a simple structure.

Thus, the tone data of a frame to be displayed (hereinafter "display frame tone data"), which is inputted to the first input of the LUT memory 32, is also inputted simultaneously to the frame memory 34. Here, the frame memory 34 outputs tone data of the last frame (hereinafter "preceding frame tone data") of the display frame. The tone data thus outputted is inputted to the second input of the LUT memory 32.

Figure 2:
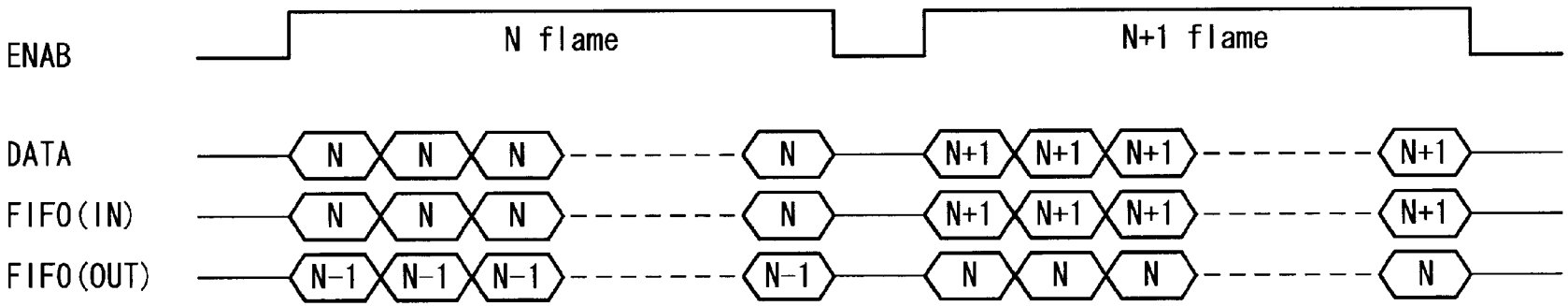
FIG. 2 is a timing chart showing a relationship of input and output of tone data with respect to a frame memory in the liquid crystal display device of FIG. 1.

FIG. 2 explains how these input and output relate to each other. FIG. 2 is a timing chart showing a relationship of input and output of the tone data with respect to the frame memory 34. Display frame tone data (FIFO (IN)) is successively applied to the frame memory 34 while a signal (ENAB) which indicates the presence of the tone data (DATA) in the data bus line is High, and, simultaneously, the frame memory 34 successively outputs preceding frame tone data (FIFO (OUT)).

Figure 3:
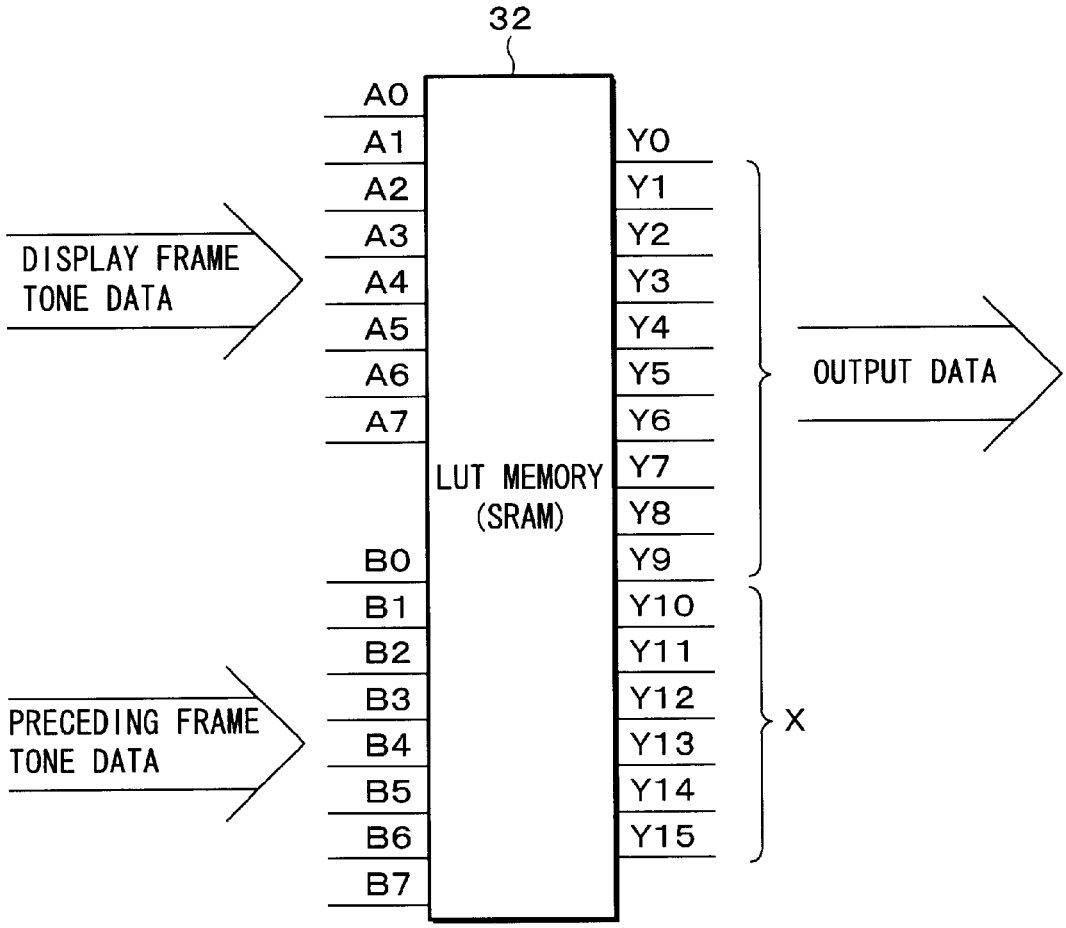
FIG. 3 is a drawing showing how pins of an LUT memory are connected in the liquid crystal display device of FIG. 1.

FIG. 3 shows pin connection of the LUT memory 32 which is an SRAM. Shown in FIG. 3 is how pins are connected in the LUT memory 32. Addresses A0 through A7 of the LUT memory 32 receive the display frame tone data, and addresses B0 through B7 receives the preceding frame tone data, i.e., the output of the frame memory 34. The LUT memory 32 then outputs tone data which is specified by these inputs based on the look-up table stored therein. Specifically, addresses of the LUT memory 32 are specified based on the respective tone data inputted to the addresses A0 through A7 and the addresses B0 through B7, and tone data stored in the specified addresses are outputted from addresses Y0 through Y9. In the present embodiment, the LUT memory 32 outputs tone data, using addresses of 0 to 9 bits, while the other addresses Y10 through Y15 remain NC (No Connection).

In this manner, the LUT memory 32 is adapted to output, based on the display frame tone data and the preceding frame tone data, specific tone data from the predefined look-up table stored in the LUT memory 32. This allows conversion of tone data without requiring other processes such as calculations, thus suppressing decrease of processing speed.

The following describes the look-up table stored in the LUT memory 32. As explained in the BACKGROUND OF THE INVENTION section with reference to FIG. 14 and FIG. 15, when tones of pixels are changed between frames, there are cases where director of liquid crystal molecules of the pixels undergoes a continuous change even after the gate becomes OFF. Here, the capacitance across electrodes of a liquid crystal cell 22 (simply "capacitance of liquid crystal cell 22" hereinafter) is changed as a result of the change in director of the liquid crystal molecules. As a result, the voltage across the electrodes of the liquid crystal cell 22 (simply "voltage of liquid crystal cell 22" hereinafter) may become different from the tone voltage which was applied while the gate was ON.

In display driving of currently available liquid crystal panels with TFTs, as described above, the tone data are sent in the form of digital data to the source driver, and it is difficult to vary the output tone voltage for each change of tones and for each pixel on the side of the source driver.

The present embodiment therefore corrects a change in tone voltage due to a capacitance change of the liquid crystal cell 22 which is caused when tones are changed, so as to improve image quality of a moving image in particular. To this end, the tone data sent to the source driver 12 is decided by the pre-defined look-up table stored in the LUT memory 32, i.e., by specifying a constant which is set beforehand according to the preceding frame tone data and the display frame tone data. The tone data which are set in the look-up table and destined to the source driver 12 are decided according to a change in capacitance of the liquid crystal cell between the current display frame and the preceding frame. Note that, the use of the LUT memory 32 allows a simpler structure and increases processing speed with ease.

When tones are changed between frames, it is preferable that the value of the tone voltage applied to the subsequent frame takes a value which is obtained by adding a value according to a ratio of capacitance change of the liquid crystal cell 22 between the frames. This realizes a tone voltage ("ideal tone voltage" hereinafter) according to luminance of a tone to be displayed by the voltage of the liquid crystal cell 22, after the director of the liquid crystal molecules has changed, i.e., after the liquid crystal molecules have fully responded. Note, however, that, in reality, a suitable voltage value may vary depending on such factors as a response speed of the liquid crystal molecules.

Here, it is assumed for simplicity that essentially no liquid crystal molecules respond when the gate is switched ON, and the response of the liquid crystal molecules completes during a frame period. Under these assumptions, the following explains one way of deciding the tone voltage which is applied when the gate is switched ON so that the voltage of the liquid crystal cell 22 becomes the ideal tone voltage when the response of the liquid crystal molecules completes.

When the number of tones is 256, the tone voltages of 256 tones, 0, 1, 2, . . . , n, . . . , m, . . . , 255 are V0, V1, V2, . . . , Vn, . . . , Vm, . . . , V255, respectively, and the capacitance of the liquid crystal cell 22 at the respective tones are C0, C1, C2, . . . , Cn, . . . , Cm, . . . , C255. Note that, these are values when the liquid crystal cell 22 is in a constant state, i.e., when displaying a still image.

When a pixel is displaying tone n and is in a constant state, the voltage and capacitance of the liquid crystal cell 22 in this state is Vn and Cn, respectively. Here, when tones are changed to display tone m in the next frame, the quantity of charge Q which needs to be stored in the liquid crystal cell 22 is given by $$Q=Cm\times Vm \quad (1).$$

However, based on the foregoing assumption that essentially no liquid crystal molecules respond at the ON of the gate, a TFT 20 is switched OFF before the capacitance of the liquid crystal cell 22 changes from Cn to Cm and while the capacitance of the liquid crystal cell 22 is still Cn. Therefore, the quantity of charge Q' actually stored in the liquid crystal cell 22 when Vm is applied to the liquid crystal cell 22 at this time becomes $$Q'=Cn\times Vm \quad (2).$$

Thus, the voltage V' required for the liquid crystal cell 22 to store charge Q is determined from Equation (1) by $$Q=Cn\times V'=Cn\times(Cm/Cn\times Vm) \quad (3)$$

and therefore from the equation $$V'=Cm/Cn\times Vm \quad (4).$$

The tone data stored in the form of the look-up table in the LUT memory 32 (hereinafter "defined tone data") are decided from the result of Equation (4), taking into consideration such factors as response of the liquid crystal cell 22 between tones, and a load capacitance 24 of a pixel. Alternatively, the defined tone data may be decided by visually inspecting the actual response of tones on the liquid crystal panel 10. These two methods are not much different in terms of results they produce, but the latter method is bound to the influence of human perception.

Figure 4:
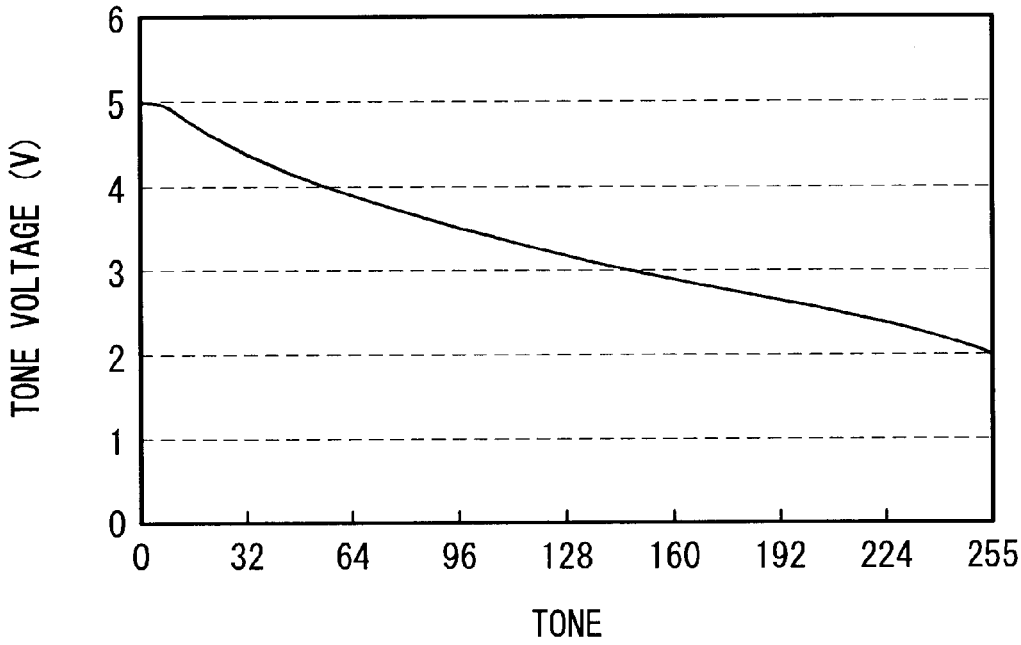
FIG. 4 is a graph showing a relationship between tone and tone voltage of a liquid crystal panel in the liquid crystal display device of FIG. 1.
Figure 5:
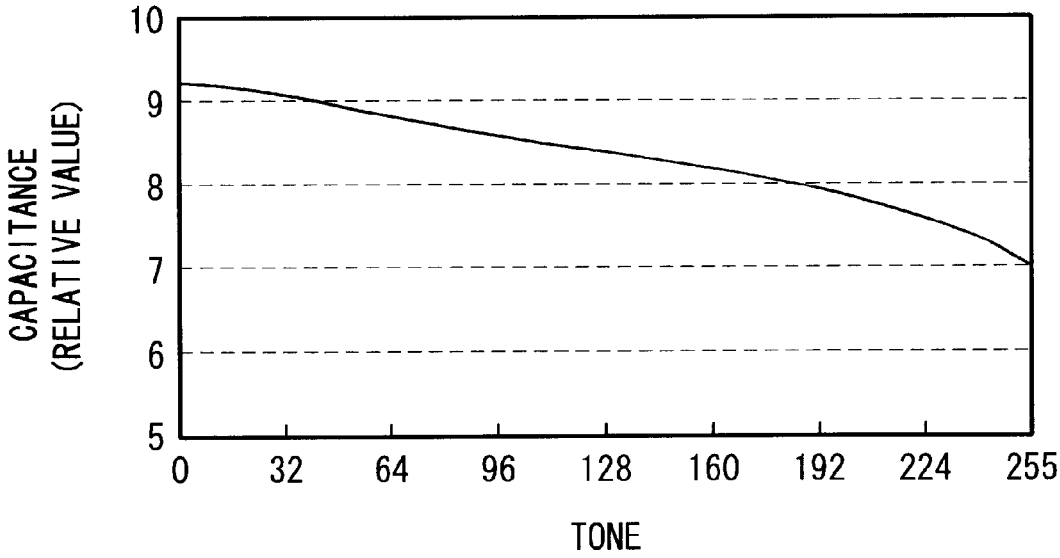
FIG. 5 is a graph showing a relationship between tone of the liquid crystal panel and capacitance of a liquid crystal cell in the liquid crystal display device of FIG. 1.

The following describes specific examples of the look-up table. FIG. 4 is a graph of tone vs. tone voltage of the liquid crystal panel 10. FIG. 5 is a graph of tone vs. capacitance (relative value) of the liquid crystal cell 22 of the liquid crystal panel 10.

FIG. 9 shows a look-up table which was created based on the data of FIG. 4 and FIG. 5 and Equation (4). Note that, the first column of FIG. 9 indicates tone data inputted to addresses B0 through B7 of the LUT memory 32, i.e., the preceding frame tone data, and the first row of FIG. 9 indicates tone data inputted to addresses A0 through A7 of the LUT memory 32, i.e., the display frame tone data. Further, the value which belongs to and specified by a predetermined row and a predetermined column of the preceding frame tone data and the display frame tone data indicates the defined tone data which is outputted based on the preceding frame tone data and the display frame tone data. Further, FIG. 9 shows the preceding frame tone data and the display frame tone data with the tones of only 0, 32, 64, 96, 128, 160, 192, 224, and 255.

In the look-up table of FIG. 9, when displaying a still image, i.e., when the preceding frame tone data and the display frame tone data are equal to each other, 8-bit data (v0 to v255) inputted to the LUT memory 32 (tone data inputted to the LUT memory 32 are indicated by v0, v1, . . . , v255) are converted within a range of tone 128 to tone 383 (256 tones). This is to avoid the defined tone data which is outputted, i.e., tone data inputted to the controller 30, from taking a negative value when displaying a moving image (to be described later). That is, by shifting the input tone data by 128 tones, defined tone data which is to take a negative value can correspond itself to defined tone data of a positive value below tone 128. Thus, the tones of FIG. 4 and FIG. 5 and the preceding frame tone data and the display frame tone data of FIG. 9 through FIG. 11 are tone data before shifting, and the defined tone data of FIG. 9 through FIG. 11 are tone data after shifting.

In the case of a moving image, in which the preceding frame tone data and the display frame tone data are different, the conversion of data is within a range of tone 120 to tone 391. Thus, in a moving image, a conversion range of defined tone data includes and is wider than the range of defined tone data of a still image. Accordingly, the source driver 12 is adapted to output tone voltages of a range corresponding to this wide range. Thus, in addition to the range from the tone voltage corresponding to black display to the tone voltage corresponding to white display, the source driver 12 can also output voltages of predetermined ranges above and below this range.

Figure 12:
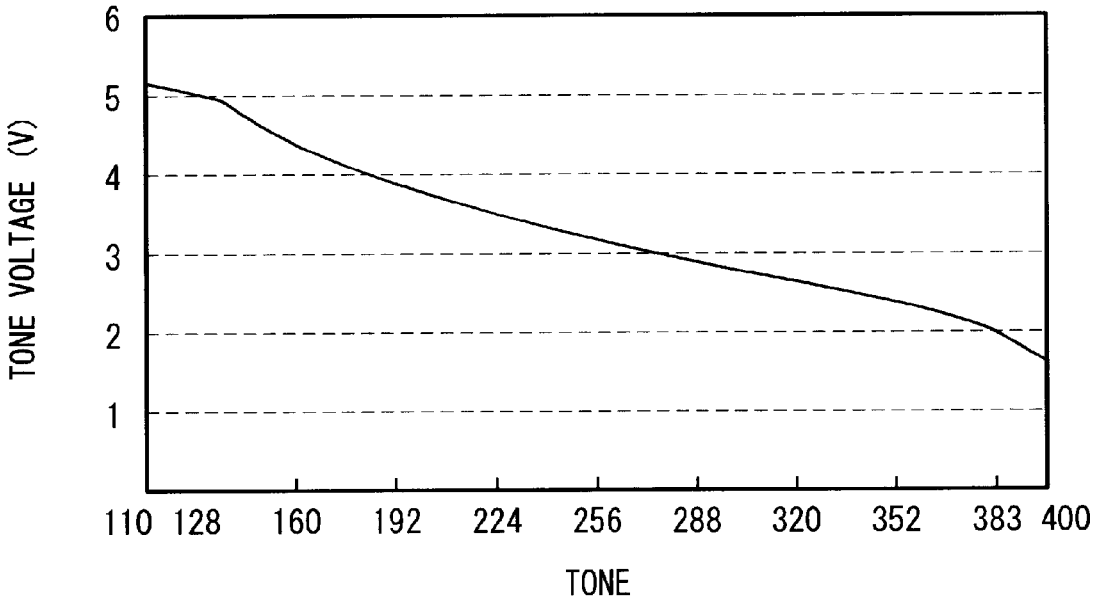
FIG. 12 is a graph showing a relationship between defined tone data and tone voltage of the liquid crystal panel of the liquid crystal display device of FIG. 1.
Figure 13:
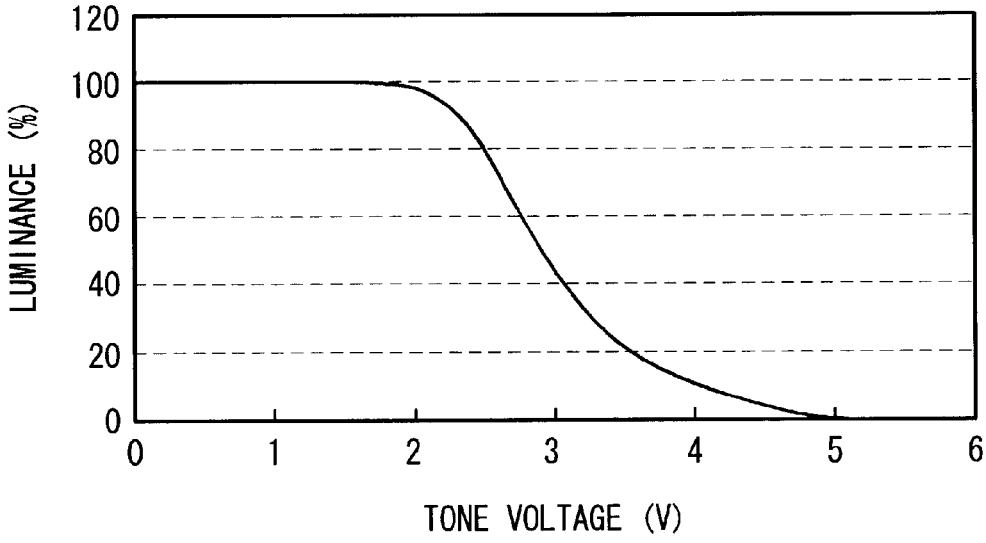
FIG. 13 is a graph showing a relationship between tone voltage and luminance of the liquid crystal panel of the liquid crystal display device of FIG. 1.

FIG. 12 shows how the tone voltage relates to the defined tone data, and FIG. 13 shows a relationship between Luminance (%) and the tone voltage. FIG. 12 is a graph of tone voltage vs. defined tone data, and FIG. 13 is a graph of luminance vs. tone voltage.

Figure 6:
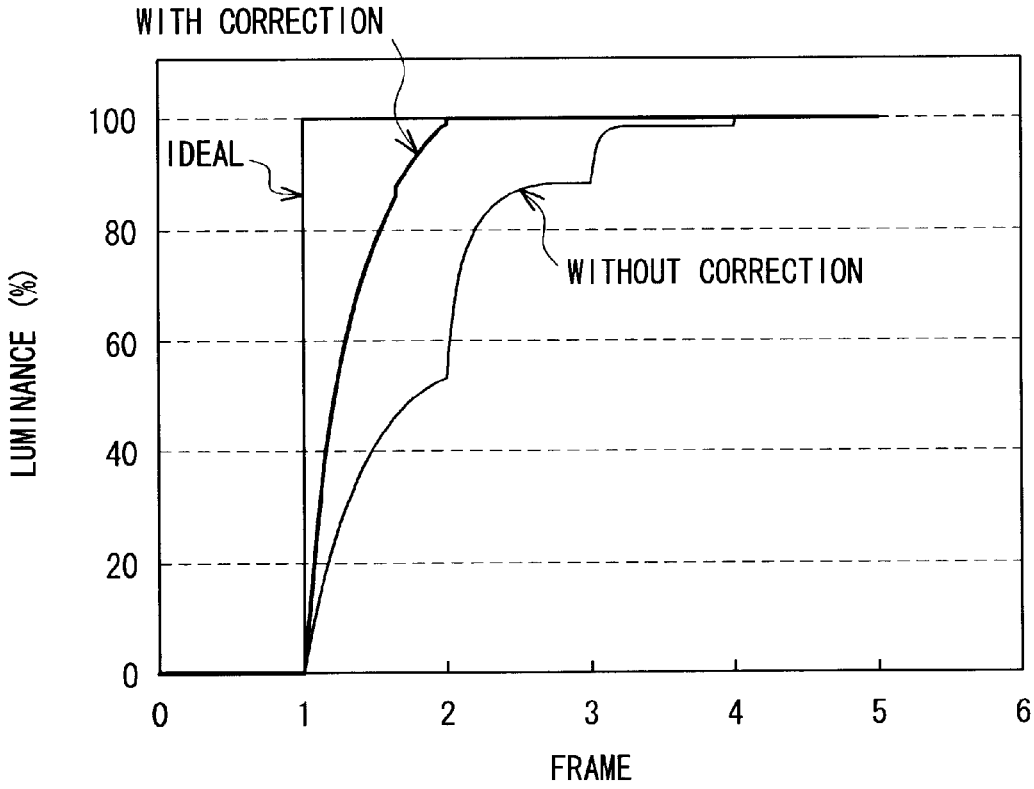
FIG. 6 is a graph showing response characteristics of display switching with and without correction of tone data using a look-up table.
Figure 7:
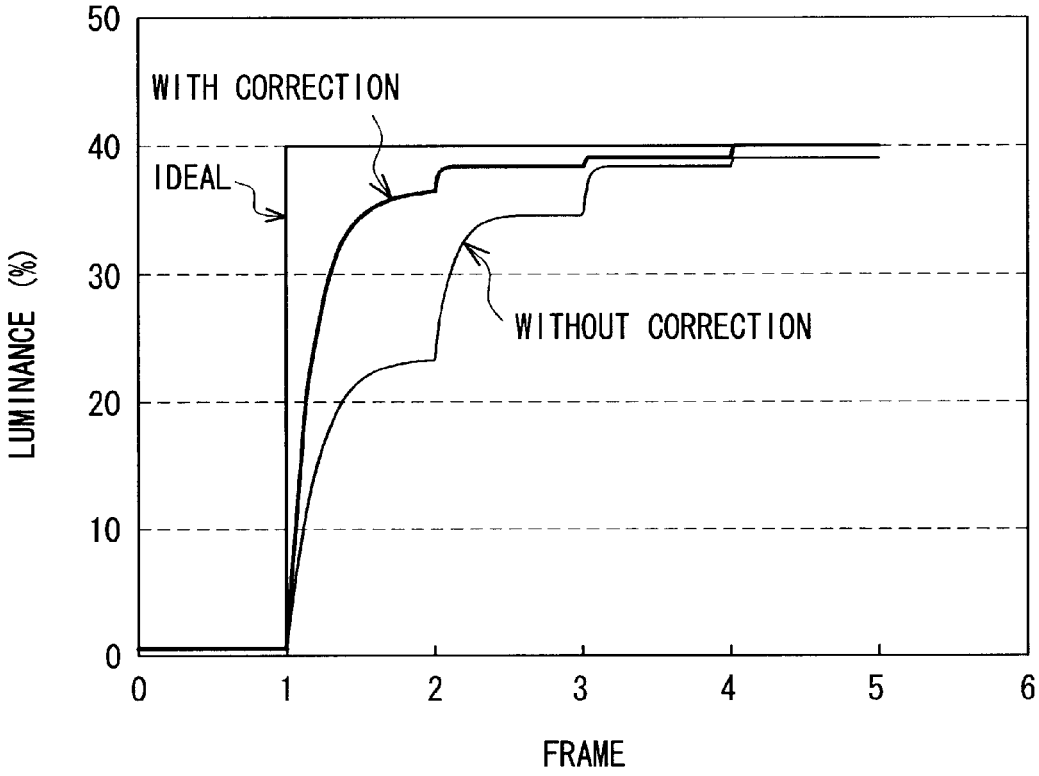
FIG. 7 is a graph showing response characteristics of display switching with and without correction of tone data using a look-up table.
Figure 8:
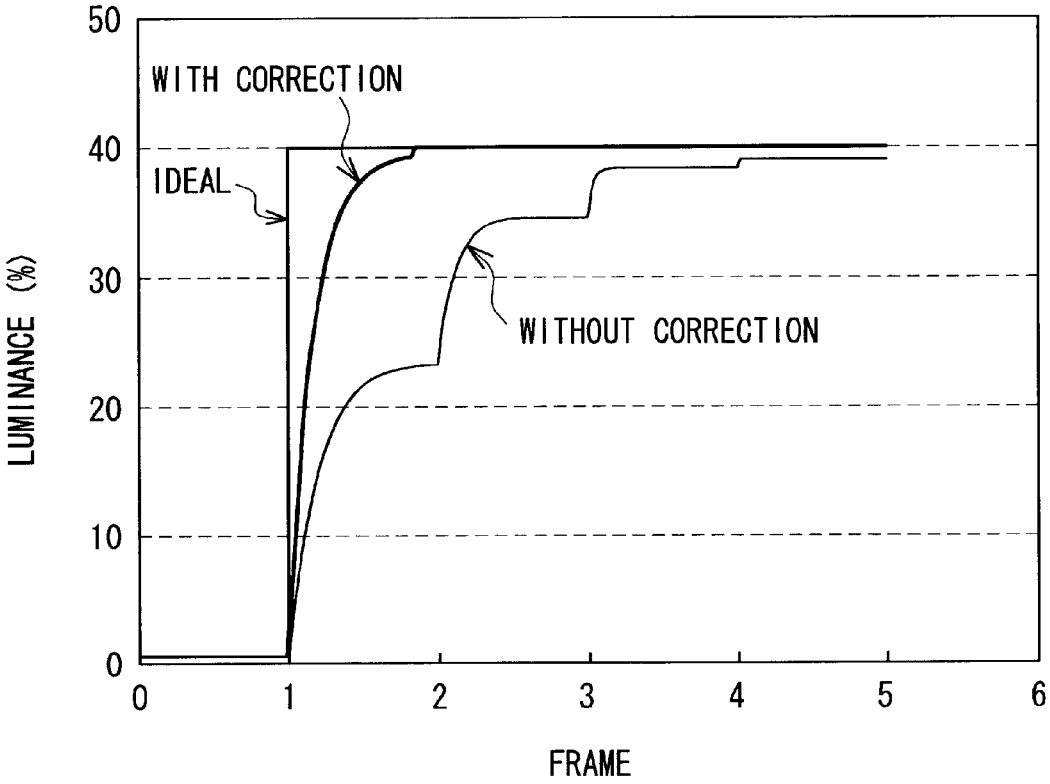
FIG. 8 is a graph showing response characteristics of display switching with and without correction of tone data using a look-up table.

FIG. 6 through FIG. 8 are graphs showing response characteristics of switched display with and without correction of tone data using the look-up table. Here, FIG. 6 is the case of the look-up table of FIG. 9, showing a change in luminance (%) when black display (v0) is switched to white display (v255) between the zeroth frame and the first frame, and the white display is maintained thereafter.

It is ideal that luminance changes from 0% to 100% at the switch of the zeroth frame to the first frame. In reality, however, luminance increases gradually due to slow response of the liquid crystal molecules and a change in capacitance of the liquid crystal cell 22. In this instance, without correction, luminance does not reach 100% even after one frame period for the foregoing reasons. When luminance does not reach the ideal value even after one frame as in this case, the display does not obey the input signal. In order to obtain the luminance of a tone to be displayed in a given frame, it is required that the luminance reaches the ideal value in this frame. The response can be improved with correction since in this case the influence of capacitance change of the liquid crystal cell 22 can be suppressed.

However, under certain conditions where a response speed of the liquid crystal molecules becomes slow, the foregoing correction may not be sufficient to improve the response. FIG. 7 shows such a condition where a response speed of the liquid crystal molecules became slow, as indicated by a change in luminance (%), for example, when half-tone display (v32) is switched to half-tone display (v192) between the zeroth frame and the first frame, and the half-tone display (v192) is maintained thereafter. In this case, despite correction, luminance does not reach the ideal value even after one frame. In a tone change like this whereby a response speed of the liquid crystal molecules becomes slow, it is preferable that the defined tone data in the look-up table of FIG. 9 take into consideration and add a value which reflects the slower response. Exact calculation of this additional value is difficult, but it can be calculated by taking into consideration a response speed of the liquid crystal molecules and by correcting the resulting value based on the actual display.

Note that, when correcting values of defined tone data, a range of correction is preferably within about 10 tones with respect to the values of the defined tone data in the look-up table of FIG. 9 based on Equation (4). Luminance may exceed the ideal value with correction of the defined tone data, but the correction of the defined tone data within the foregoing range can bring the luminance of display back to the ideal value within one frame even when it exceeds the ideal value. Note, however, that this range may vary depending on such factors as displayed tones, liquid crystal material, and display mode.

Defined tone data determined in this manner are shown in FIG. 10, which is an example of a look-up table which was obtained by correcting the look-up table of FIG. 9. Note that, in FIG. 10, changes of defined tone data from FIG. 9 are indicated by underline.

In the defined tone data of FIG. 10, in a still image, v0 to v255 are also converted within a range of tone 128 to tone 383 (256 tones). In the look-up table of FIG. 10, the defined tone data for changes from half-tone display of relatively lower tones to half-tone display of relatively higher tones have larger values than those in the look-up table of FIG. 9. This is because the response speed of the liquid crystal molecules is particularly slow in these changes. Note that, there are cases where values of defined tone data need to be changed with respect to changes from half-tone display of relatively higher tones to half-tone display of relatively lower tones.

FIG. 8 shows a change in luminance (%) when half-tone display (v32) is switched to half-tone display (v192) between the zeroth frame and the first frame, and the half-tone display (v192) is maintained thereafter. FIG. 8, however, uses the look-up table of FIG. 10 for the correction. In this case, by the correction, luminance reaches the ideal value after one frame period.

Note that, in the event where the source driver 12 is not adapted to output voltages outside of the range from the tone voltage corresponding to black display to the tone voltage corresponding to white display of the liquid crystal cell 22, the defined tone data are set as shown in FIG. 11 so that correction is carried out only within a range of half-tone display. FIG. 11 is an example of a look-up table employing such a source driver 12.

In this case, the defined tone data fall within a range of tone 0 to tone 255 (256 tones). This correction is not effective in a tone change from white display to black display, but can improve a response speed in switching half-tone display to improve display quality of a moving image.

The following explains the defined tone data which are set in the look-up table in more detail.

The look-up table shown in FIG. 9 is set based on step charge-discharge characteristics, but it may be inappropriate depending on the time (response time) required for the liquid crystal molecules to respond. Thus, it is preferable, as shown in the look-up table of FIG. 10, to set defined tone data with more correction than that based on the capacitance change (correction based on Equation (4)), taking into consideration a long response time of the liquid crystal molecules. The effects of this correction are explained below by way of a correction method which is simple and effective but cannot be used in reality.

Figure 31:
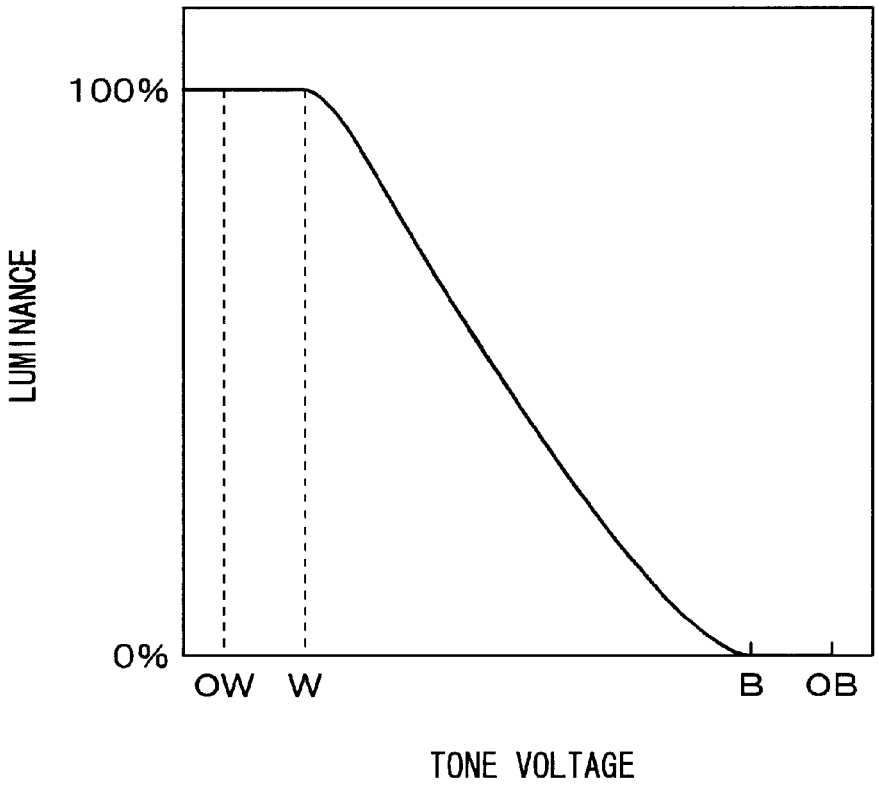
FIG. 31 is a virtual graph showing a relationship between tone voltage and luminance.

FIG. 31 is a virtual graph showing a relationship between tone voltage and luminance. FIG. 31 assumes over-black tone voltage OB and over-white tone voltage OW which are used for correction, outside of a range of display tone voltages, i.e., a range of tone voltage corresponding to the range of luminance from 0% to 100%. The over-black tone voltage OB and the over-white tone voltage OW are set to be sufficiently high and low, respectively, with respect to any combination of tone changes. That is, the over-black tone voltage OB and the over-white tone voltage OW are set to be sufficiently high and low, respectively, with respect to tone voltages which correspond to all defined tone data of the look-up table of FIG. 9. Note that, the tone voltage which corresponds to black display (0% luminance) and the tone voltage which corresponds to white display (100% luminance) will be called black tone voltage B and white tone voltage W, respectively.

Here, by effecting the over-white tone voltage OW and the over-black tone voltage OB when tones are changed from a darker tone to a brighter tone and from a brighter tone to a darker tone, respectively, the liquid crystal molecules can fully respond to all tone changes within one frame period.

Figure 32:
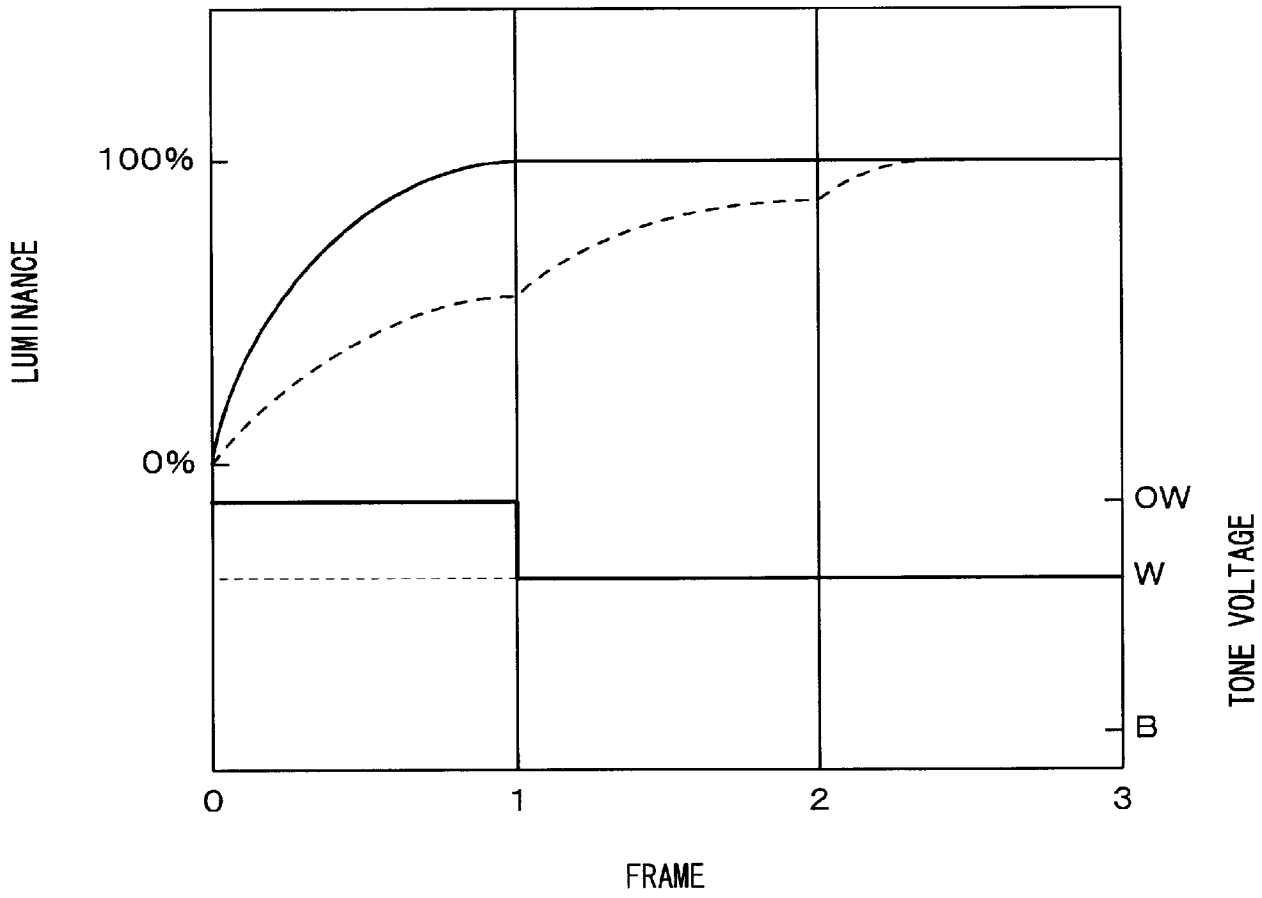
FIG. 32 is a graph showing changes in tone voltage and luminance when display is changed from black display to white display at the start of the zeroth frame and when the white display is maintained through the first and second frames.
Figure 33:
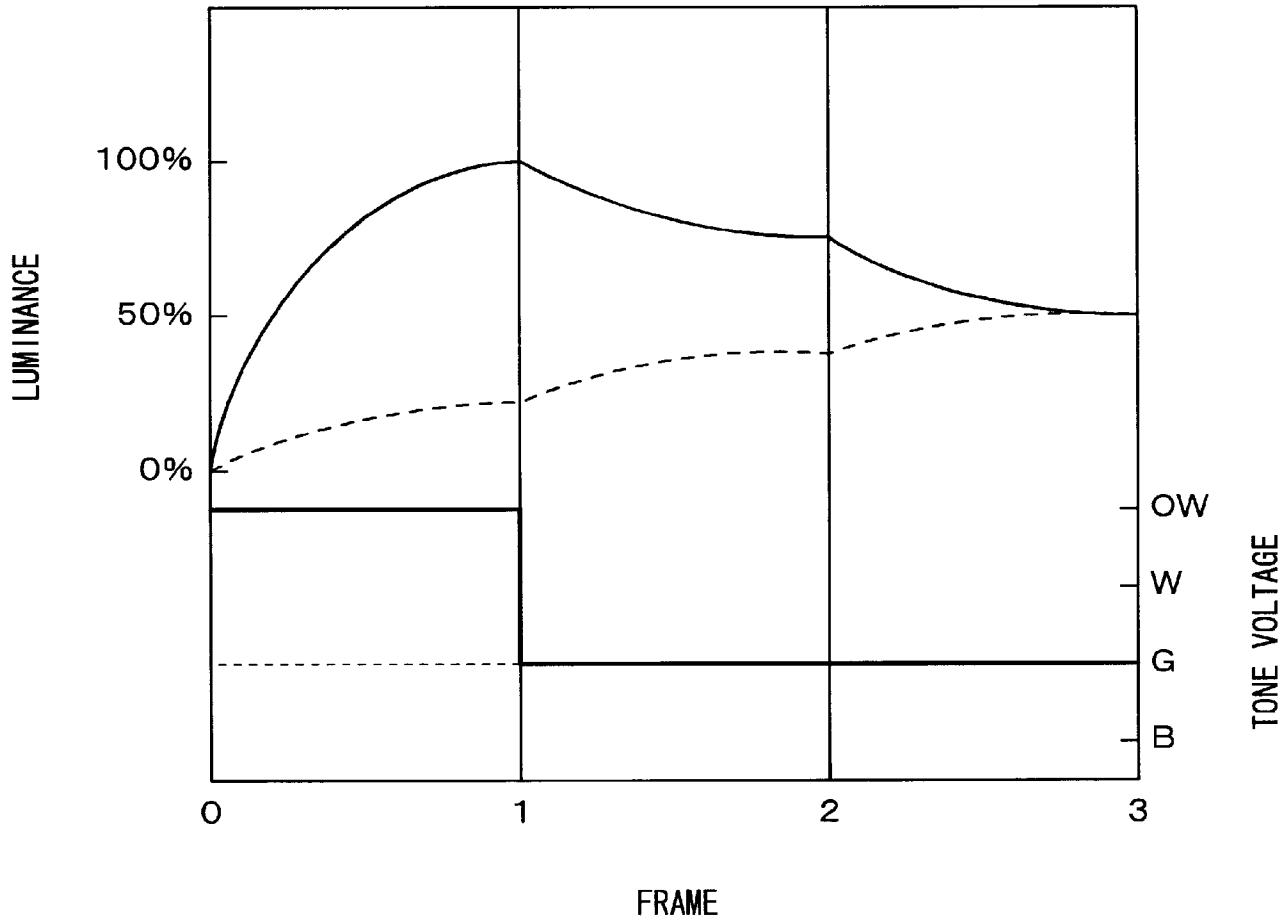
FIG. 33 is a graph showing changes in tone voltage and luminance when display is changed from black display to grey display (50% luminance) at the start of the zeroth frame and when the grey display is maintained through the first and second frames.

However, the foregoing correction actually has the following drawbacks. FIG. 32 is a graph which shows changes of tone voltage and luminance when display is changed from black display to white display at the start of the zeroth frame and a white display is maintained through the first and second frames. In FIG. 32, the solid line indicates the case where the over-white tone voltage OW is used in the zeroth frame, and the broken line indicates the case where white tone voltage W is used in the zeroth frame (i.e., no correction). FIG. 33 is a graph which shows changes of tone voltage and luminance when display is changed from black display to grey display (50% luminance) at the start of the zeroth frame and the grey display is maintained through the first and second frames. In FIG. 33, the solid line indicates the case where the over-white tone voltage OW is used in the zeroth frame, and the broken line indicates the case where grey tone voltage W is used in the zeroth frame (i.e., no correction). It can be seen from FIG. 32 that the step-wise response which occurs between frames without correction can be eliminated with the use of the over-white tone voltage OW, thus desirably obtaining fast response. However, in FIG. 33, with the use of the over-white tone voltage OW, the white display is reached before the start of the first frame. That is, the response far exceeds the target tone. It is worth noting here that the use of the over-white tone voltage OW reduces the time required to reach the target tone to about 1/6 frame period, thus obtaining a shorter response time. However, a shorter response time is meaningless when the target tone cannot be obtained. Further, the excessive response has adverse effects on subsequent frames. That is, it takes two to three frame periods to bring the over-tone back to the target tone. The correction of reducing response time is not performed in these subsequent frames. This is because the displayed tones in these frames are grey display which is constant and shows no tone change, and regarded as display of a still image.

The foregoing example is extreme but the same phenomenon results when the correction is such that the displayed tone after one frame period is widely different from the target tone while it may reduce response time. In order to avoid this, it is preferable that the defined tone data which are set in the look-up table of the LUT memory 32 has such tones that the luminance of display at the end of a time period (one frame period) which corresponds to one frame, i.e., the luminance of display immediately before the tone voltage of the next frame is applied, is within a range of 90% to 110% of the target luminance (luminance of the tone to be displayed, ideal value), i.e., a range with a gain and loss of ±10% with respect to the target luminance. Use of defined tone data exceeding this range causes luminance of the frame displayed by these defined tone data to be perceived as being widely different from the target luminance, and it may cause abnormal display in the subsequent frames. This is also true in other embodiments of the present invention.

The benefit of setting the defined tone data within a range of gain and loss of ±10% of the target luminance was confirmed by the following experiment.

Figure 40:
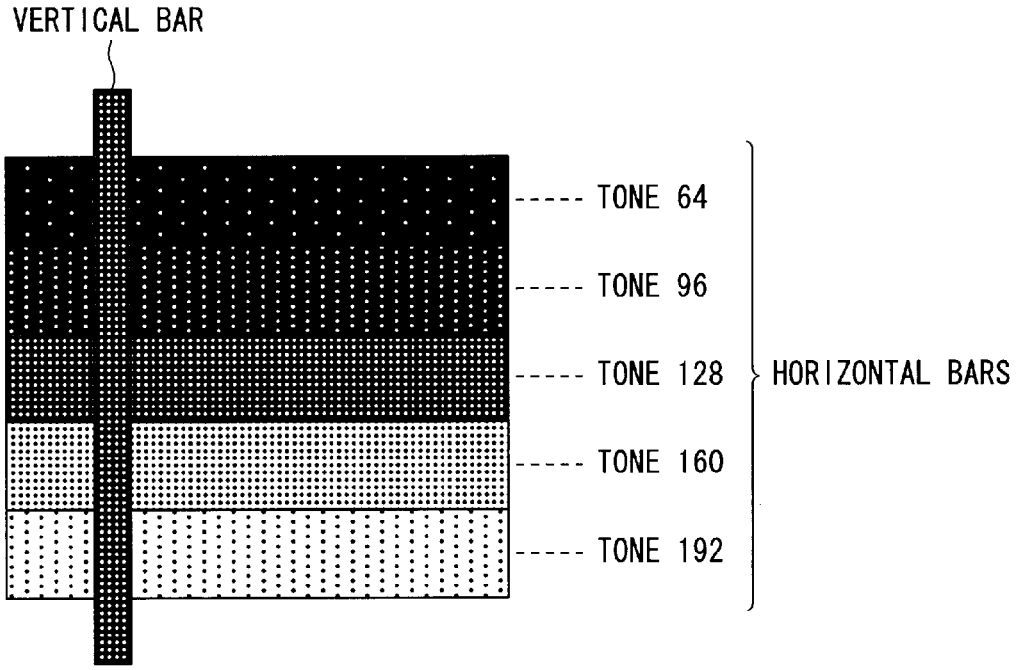
FIG. 40 is a conceptual view showing an evaluated image used in an experiment for evaluating images.

In the experiment, a test image as shown in FIG. 40 was displayed on nine types of displays, and the test image was evaluated subjectively by 50 subjects. FIG. 40 is a conceptual view of the test image used in the experiment. The test image had a display pattern including half-tone horizontal tone bars, and a half-tone vertical bar was scrolled thereon in a horizontal direction. Also, the test image had a display area of 640 dots×480 dots. Further, the horizontal tone bars were made up of horizontal bars of tone 64, tone 96, tone 128, tone 160, and tone 192, which were arranged in this order from the top. The vertical bar was a randomly chosen tone of tone 64, tone 128, or tone 192. The scroll speed of the vertical bar in the horizontal direction was 4 dots/frame (60 Hz).

The evaluation was made by the subjects with respect to a blur around the edges of the vertical bar based on the criteria indicated in FIG. 41. FIG. 41 is a table which shows the evaluation criteria of this experiment. The nine displays used in the experiment are as indicated in FIG. 42, and each display was set so that the gain and loss of luminance fell within the ranges shown in FIG. 42. FIG. 42 is a table which indicates types of displays used in the experiment, as well as ranges of gain and loss of luminance which are set for the respective displays, and results of evaluation. The results of evaluation are indicated by the average points of the evaluation criteria given by the subjects. While it was difficult for the liquid crystal televisions, which are liquid crystal display devices, to have a gain and loss of 0% and the evaluation point of 5.0 like the impulse display such as the CRT, the liquid crystal displays had the evaluation points of 3.0 or above with a gain and loss of luminance within ±10% and many subjects judged that at least the display error was non-prominent. Thus, the experiment showed that a gain and loss of luminance within ±10% does not pose any problem in practical applications.

It can be said that the correction method of the present invention which make correction by setting defined tone data in advance in the look-up table is superior particularly in terms of versatility because it offers proper setting of tone correction according to not only electrical characteristics of the liquid crystal panel 10 but also response characteristics of liquid crystal molecules themselves, as well as characteristics of visual perception of humans.

Note that, the LUT memory 32 may be adapted to carry out conversion by calculation so as to reduce memory space or the number of connection pins. It is also preferable in this case to confine a gain and loss of the changing tone at the end of one frame period within ±10% of the target tone. For example, a possible calculation is to feedback a tone difference due to a slow response speed between close tones so as to compensate for a small change.

As described, the liquid crystal display device in accordance with the present invention includes the frame memory 34 which stores the preceding frame tone data for recognizing a tone change of each pixel between frames. Referring to the look-up table which is stored beforehand in the LUT memory 32, the defined tone data which is specified based on the display frame tone data and the previous frame tone data which are stored in the frame memory 34 is outputted to the controller 30. That is, the LUT memory 32 converts and outputs tone data by the look-up table stored therein based on the previous frame tone data and the display frame tone data.

The tone data which the LUT memory 32 outputted to the controller 30 is applied to the source driver 12. The source driver 12 then applies a tone voltage which corresponds to the tone data via the source bus line 16 to the liquid crystal cell 22 and the load capacitor 24 of a pixel corresponding to this tone data, so as to carry out tone display on this pixel.

The tone data is converted by the look-up table into tone data corresponding to such a tone voltage which enables intended tone display when tones are changed. This makes it possible to apply an optimum tone voltage to the liquid crystal panel 10, thus improving quality of moving images in particular.

Note that, the look-up table can be set conveniently based on Equation (4) as described above, but the calculated value may not always be accurate because the response of liquid crystal molecules initiated by ON of the gate is gradual in the actual liquid crystal cell 22. In particular, in such a case where response of the liquid crystal molecules does not complete within one frame, it is preferable that the correction value is increased to be larger than the calculated value.

Here, use of an SRAM as the LUT memory 32 is preferable because it can process fine image data with high frequencies.

This allows the data of the controller 30 to be outputted to elements such as the source driver 12 as conventionally done. That is, the source driver 12 or other elements after the controller 30 can adopt a conventional arrangement.

However, in the source driver 12 of a conventional arrangement, a range of tone voltage which the source driver 12 can output may be limited between a tone voltage corresponding to white display and a tone voltage corresponding to black display of the liquid crystal cell 22. In this case, the tone voltage corresponding to black display, by no choice, needs to be outputted directly, for example, when display is changed from white display to black display, and this may prevent correction to be carried out properly. This contrasts to the source driver 12 which can output tone voltages outside the range of the tone voltages corresponding to black display and white display, respectively (for example, a tone voltage above the tone voltage corresponding to white display, and a tone voltage below the tone voltage corresponding to black display), which enables proper correction.

In order to apply the tone voltage to the liquid crystal cell 22 even after correction, the present embodiment selects a tone voltage which corresponds to the applied tone voltage, according to the preceding frame tone data and the display frame tone data using the LUT memory 32. This enables easier tone conversion.

As described, in the present embodiment, a change of applied voltage which occurs when tones are changed is minimized by applying a tone voltage which compensates for the change in advance, so as to complete response of the liquid crystal molecules within one frame, thereby improving display quality of moving images in particular.

Further, with the use of the LUT memory 32, it is possible to provide the system capable of applying a tone voltage which compensates for unmatched applied voltages due to a tone change with a simpler structure.

As described, the liquid crystal display device according to the present embodiment carries out tone display with pixels by applying a tone voltage according to tone data to each pixel in each frame, and includes: a converter, which receives tone data of a display frame and tone data of an immediately preceding frame, for converting and outputting the tone data of the display frame; a driver for applying the tone voltage to the pixels based on the converted tone data outputted from the converter; and a liquid crystal cell, which makes up the pixels, for realizing tone display by the applied tone voltage, wherein the converter stores beforehand output tone data which is specified by the tone data of the display frame and the tone data of the immediately preceding frame.

The converter converts the tone data of the display frame to reduce a mismatch between tone data and the actual tone displayed on the liquid crystal cell due to a change in electric capacitance of the liquid crystal cell of a pixel caused by a change in tone voltage applied to this pixel. Specifically, when the tone indicated by the tone data of the display frame is higher than the tone indicated by the tone data of the immediately preceding frame, the converter converts the tone data of the display frame so as to increase the tone indicated by the tone data of the display frame, and when the tone indicated by the tone data of the display frame is lower than the tone indicated by the tone data of the immediately preceding frame, the converter converts the tone data of the display frame so as to reduce the tone indicated by the tone data of the display frame.

It is preferable that in the liquid crystal display device of the present embodiment, in the foregoing liquid crystal display device, the converter further includes a first input and a second input, and the second input is connected to a memory section which stores inputted tone data and outputs the stored tone data after delaying it by one frame period, and tone data is inputted to the first input, and also to the second input via the memory section.

According to this arrangement, the tone data of the display frame is directly inputted to the first input of the converter, and also to the second input of the converter via the memory section. The memory section outputs the inputted tone data by delaying it by one frame. In this way, the tone data of the display frame and the tone data of the immediately preceding frame can be inputted to the converter with a simple structure.

It is preferable that in the liquid crystal display device of the present embodiment, in the arrangement where the converter has the first and second inputs, the converter comprises a memory which outputs stored tone data of addresses as specified by the respective tone data inputted to the first input and the second input.

According to this arrangement, the tone data can be converted without other processes such as calculations, thus preventing lowering of processing speed which is caused by processes of converting the tone data.

It is preferable that in the liquid crystal display device of the present embodiment, in any of the foregoing liquid crystal display devices, a range of the tone voltage which the driver outputs includes and wider than a range of tone voltage which corresponds to a display range of tones of a still image displayed by the liquid crystal cell.

When changing display of the liquid crystal cell, for example, to the upper limit (lower limit) of a tone display range from another tone, there are cases where it is preferable to apply a voltage at or above (below) the tone voltage which corresponds to the upper limit (lower limit) to correct the influence of the capacitive change of the liquid crystal cell. The foregoing arrangement can adapt to such cases and enables this correction.

It is preferable that in the liquid crystal display device of the present embodiment, in any of the foregoing liquid crystal display devices, the tone data stored in the converter corresponds to tone voltage V' which is determined by $$V'=Cm/Cn\times Vm$$

where Vm is a tone voltage when the tone data of the display frame is displayed as a still image, Cm is an electric capacitance of the liquid crystal cell when the tone data of the display frame is displayed as a still image, and Cn is an electric capacitance of the liquid crystal cell when the tone data of the immediately preceding frame is displayed as a still image.

According to this arrangement, it becomes easier, based on the foregoing equation, to set the tone data to be outputted from the converter which is capable of correcting the influence of capacitive change of the liquid crystal cell.

It is preferable that in the liquid crystal display device of the present embodiment, in the foregoing liquid crystal display device, the tone data stored beforehand in the converter is set so that, when the pixels realizes tone display based on this tone data, luminance of a pixel after an elapsed time period which corresponds to one frame from application of the tone voltage to the pixel based on the tone data falls within a range of 90% to 110% of intended display luminance.

Use of tone data exceeding this range causes luminance of the frame displayed by the tone data to be perceived as being widely different from the intended luminance, i.e., from the luminance which corresponds to the tone indicated by the tone data of the display frame, and it may cause abnormal display in the subsequent frames. The foregoing arrangement prevents such problems.

[Second Embodiment]

The following will describe the Second Embodiment of the present invention with reference to FIG. 16 through FIG. 19. An active-matrix liquid crystal display device of the present embodiment has a structure which is basically the same as that described in the First Embodiment based on FIG. 1, and only differences from the First Embodiment are described below. The active-matrix liquid crystal display device according to the present embodiment includes an LUT memory (convertor, memory) 36 instead of the LUT memory 32, and input and output of the LUT memory 36 are different from those of the First Embodiment.

Figure 16:
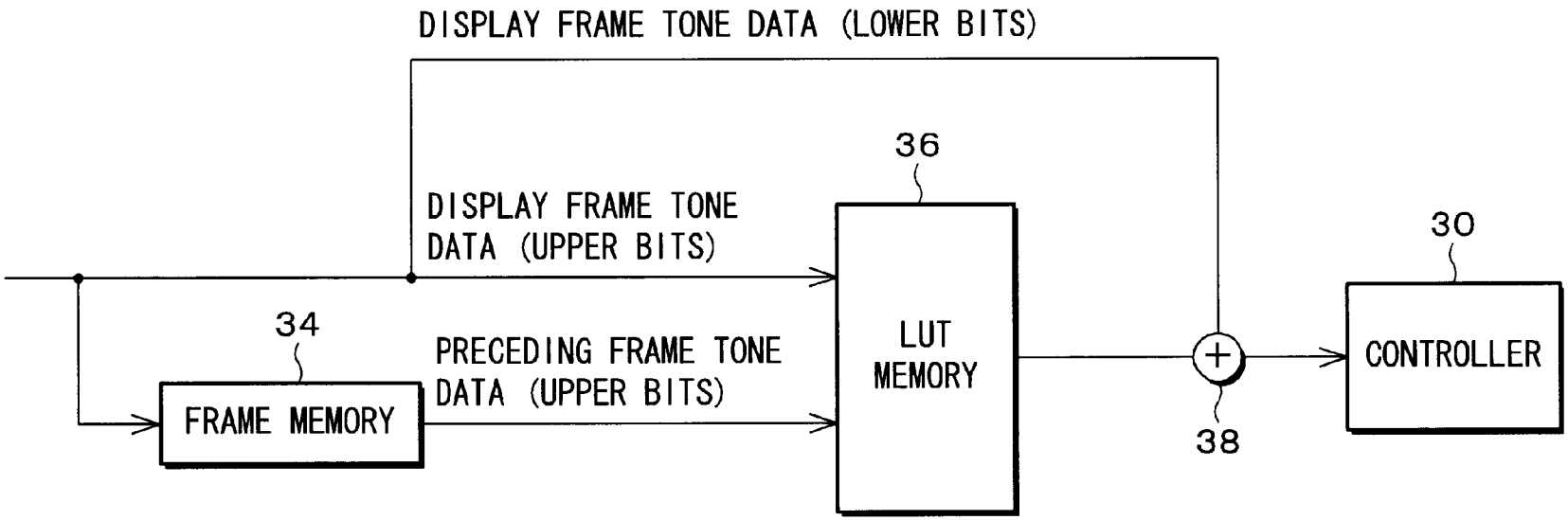
FIG. 16 is a block diagram showing a structure around an LUT memory according to the Second Embodiment of the present invention.

FIG. 16 is a block diagram showing a structure surrounding the LUT memory 36 according to the present embodiment. The LUT memory 36 receives only upper bits (upper digits) of the respective display frame tone data and preceding frame tone data. The LUT memory 36 is adapted to output specific defined tone data from a predetermined look-up table which is stored in the LUT memory 36, based on input of the respective upper bits of the display frame tone data and the preceding frame tone data. The output of the LUT memory 36 is also the defined tone data of only the upper bits which correspond to the input. The defined tone data of only the upper bits outputted from the LUT memory 36 and the lower bits (lower digits) of the display frame tone data are added in an adder 38 and outputted to a controller 30.

As described in the First Embodiment, conversion of tone data based on all bits of the tone data enables optimum conversion, i.e., conversion with least errors. However, for example, in tone data of 8 bits (256 tones), an error which may arise by not taking into account the lower 2 bits (equivalent of 4 tones) in conversion of the tone data is not significant and does not pose a problem in practical applications. Meanwhile, the conversion by the LUT memory 36 based only on the upper bits of the tone data allows the use of LUT memory 36 and frame memory 34 of a smaller capacity, which reduces cost of the device. For example, in contrast to the LUT memory 32 of FIG. 3, the LUT memory 36 only needs to include addresses A0 through A5 for receiving upper bits of the display frame tone data, addresses B0 through B5 for receiving upper bits of the preceding frame tone data, and addresses Y0 through Y5 for outputting the converted defined tone data of only the upper bits.

As noted above, without taking into account the lower bits in conversion of the tone data, an error equivalent of (lower bit value)/(whole bit value) occurs when tones of pixels are changed between frames. However, while this diminishes the effect of the correction described in the First Embodiment, the effect is still present and sufficient.

A look-up table which is suitable for the arrangement of the present embodiment was set in the LUT memory 36, and this was compared with the LUT memory 32 of the First Embodiment with the suitable look-up table. The conversion of tone data based on only the upper 6 bits in the arrangement of the present embodiment was compared with the conversion of tone data based on all 8 bits in the arrangement of the First Embodiment with respect to all changes of tone data between frames. The result showed that the difference in the tone data inputted to the controller 30 (hereinafter "correction tone data". Note that, in the First Embodiment, the defined tone data was the correction tone data) between the two embodiments was less than 4 tones in most cases. The difference of not less than 4 tones appeared in 334 cases out of the total of 65536 combinations of tone changes between adjacent frames, which is about 0.5%. The largest difference occurred when the preceding frame tone data was tone 251 and the display frame tone data was tone 87, which is a difference of 22 tones in the correction tone data, and a difference of 0.35 V between tone voltages.

FIG. 17 and FIG. 18 are tables showing part of the look-up tables which were set in the LUT memory 32 and the LUT memory 36, respectively, in the foregoing comparison. Here, the tone voltage which corresponds to tone 87 without correction (no conversion of tone data) was 4.025 V. Further, when the preceding frame tone data and the display frame tone data had tone 251 and tone 87, respectively, the tone voltage was 5.495 V (corresponds to tone 1) with the conversion of the tone data based on all 8 bits, whereas the tone voltage was 5.145 V (corresponds to tone 23) with the conversion based on only the upper 6 bits. Thus, there was a tone voltage difference of 0.35 V (corresponds to 22 tones) between the conversion of the tone data based on all 8 bits and the conversion based on only the upper 6 bits. Nevertheless, the effect of correction is large because the tone voltage with the correction based on only the upper 6 bits is 5.145 V, instead of 4.025 V without the correction, which gives a difference of more than 1 V in the applied tone voltage.

As described, in the present embodiment, the LUT memory 36, which makes up the converter, converts the display frame tone data into the correction tone data based on the display frame tone data and the preceding frame tone data. Here, the LUT memory 36 specifies defined tone data of only the upper bits from the stored data, based on the upper bits (upper digits) of the display frame tone data and the upper bits of the preceding frame tone data. The number of the upper bits is not particularly limited, and the upper 6 bits of the 8 bits may be used, for example. By this conversion of the tone data based on the predetermined upper bits of the tone data, the data volume processed in the LUT memory 36 can be reduced. This allows the use of a memory (LUT memory 36) with smaller numbers of input/output pins and a smaller memory space, thus simplifying circuit elements.

Note that, it is preferable that the adder 38 adds the remaining lower bits (lower digits) of the display frame tone data to the defined tone data of only the upper bits which was specified by the LUT memory 36, so as to create correction tone data which is inputted to the controller 30. Here, the adder 38 also makes up the converter. This reduces errors which may occur in the conversion of the tone data based only on the upper bits.

Figure 19:
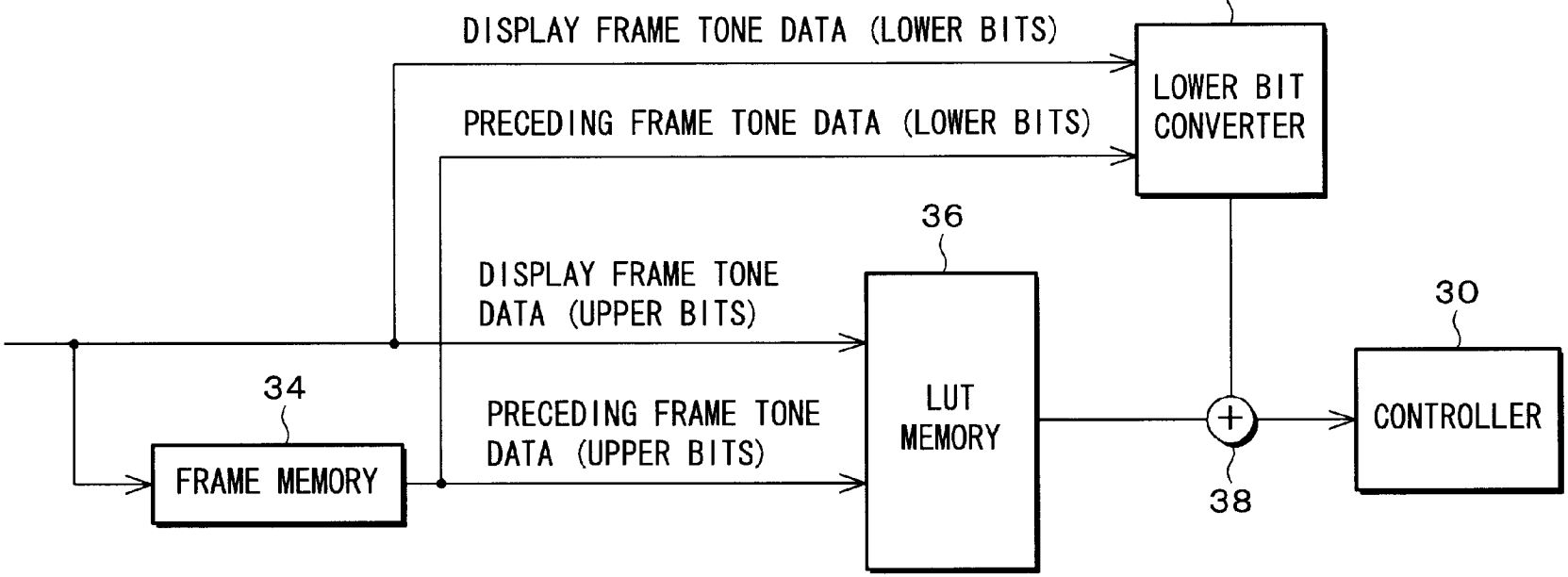
FIG. 19 is a block diagram showing a structure around the LUT memory according to the Second Embodiment of the present invention.

Further, with regard to the lower bits, the lower bits of the display frame tone data may be converted by the lower bit converter 37 based on the lower bits of the preceding frame tone data, and the result of conversion may be added by the adder 38 to the defined tone data of only the upper bits which was specified by the LUT memory 36. This is depicted in FIG. 19. FIG. 19 is a block diagram showing a structure around the LUT memory 36 according to a modification example of the present embodiment. The lower bit converter 37 also makes up the converter.

The lower bits of the display frame tone data may be directly added when the values of the respective lower bits of the display frame tone data and the preceding frame tone data are the same. However, when they are different, the lower bits of the display frame tone data should be converted. For example, when the lower bits of the display frame tone data are larger than the lower bits of the preceding frame tone data, the lower bits of the display frame tone data should be converted to a larger value. Conversely, when the lower bits of the display frame tone data are smaller than the lower bits of the preceding frame tone data, the lower bits of the display frame tone data should be converted to a smaller value.

The following describes a more specific example. Note that, the binary values in the following example are used only for the purpose of illustration and do not necessarily reflect the actual values. It is assumed here that the preceding frame tone data and the display frame tone data are "00000000" and "10000011", respectively, and the result of optimum conversion based on all 8 bits as in the First Embodiment is "111001100", and that based on the upper 6 bits is "110000(00)". Under this assumption, when the lower 2 bits of the display frame tone data, "11", is simply added to the result of conversion using the upper 6 bits, the resulting value will be "11000011". This is different from "111001100" which resulted from the optimum conversion based on all 8 bits, and there is an error of "1001".

On the other hand, since the lower 2 bits of the display frame tone data, "11", is larger than the lower 2 bits of the preceding frame tone data, "11001", the resulting value will be "111000100" when the lower 2 bits of the display frame tone data are added after converting it to "100". In this case, an error is "1000", which is smaller than the error of the foregoing simple addition.

The lower bit converter 37 may be realized by an LUT memory, or by an arithmetic circuit designed to perform simple calculations. When adopting the LUT memory, specific data is outputted from a predetermined stored look-up table based on the respective lower bits of the inputted display frame tone data and preceding frame tone data, as in the LUT memory 36. Further, since the data outputted from the lower bit converter 37 need not be specific, the output data may be created by performing predetermined simple calculations with respect to the respective lower bits of the inputted display frame tone data and preceding frame tone data. For example, a constant multiple of a difference between the respective lower bits of the display frame tone data and the preceding frame tone data may be outputted after added to the lower bits of the display frame tone data.

As described, the liquid crystal display device of the present embodiment carries out tone display with pixels by applying a tone voltage according to tone data to each pixel in each frame, and includes: a converter for converting tone data of a display frame to correction tone data based on the tone data of the display frame and tone data of an immediately preceding frame; a driver for applying the tone voltage to the pixels based on the correction tone data obtained in the converter; and a liquid crystal cell, which makes up the pixels, for realizing tone display by the applied tone voltage, wherein the converter stores beforehand defined tone data which is specified by the tone data of the display frame and the tone data of the immediately preceding frame, and the converter generates the correction tone data based on the specified defined tone data.

The converter converts the tone data of the display frame to reduce a mismatch between tone data and the actual tone displayed on the liquid crystal cell due to a change in electric capacitance of the liquid crystal cell of a pixel caused by a change in tone voltage applied to this pixel. Specifically, when the tone indicated by the tone data of the display frame is higher than the tone indicated by the tone data of the immediately preceding frame, the converter converts the tone data of the display frame so as to increase the tone indicated by the tone data of the display frame, and when the tone indicated by the tone data of the display frame is lower than the tone indicated by the tone data of the immediately preceding frame, the converter converts the tone data of the display frame so as to reduce the tone indicated by the tone data of the display frame.

It is preferable in the liquid crystal display device that the converter specifies the defined tone data based on upper digits of the tone data of the display frame and upper digits of the tone data of the immediately preceding frame, the converter converting the tone data of the display frame by replacing the upper digits of the tone data of the display frame with the specified defined tone data, and generating the correction tone data based on a result of conversion.

According to this arrangement, the tone data is converted based on the predetermined upper digits (upper bits) of the tone data. This reduces the data volume processed by the converter, thus simplifying the converter. For example, less memory space is required for the part of the converter which stores the correction tone data.

It is preferable in the liquid crystal display device, in the liquid crystal display device which carries out conversion based on upper digits, the converter converts the upper digits of the tone data of the display frame based on the upper digits of the tone data of the display frame and the upper digits of the tone data of the immediately preceding frame, and generates the correction tone data by adding the converted upper digits of the tone data of the display frame to lower digits of the tone data of the display frame.

According to this arrangement, by adding the remaining lower digits (lower bits) of the tone data, less error is incurred compared with the conversion based only on the upper digits.

Alternatively, it is preferable in the liquid crystal display device, in the liquid crystal display device which carries out conversion based on upper digits, the converter converts the upper digits of the tone data of the display frame based on the upper digits of the tone data of the display frame and the upper digits of the tone data of the immediately preceding frame, and converts lower digits of the tone data of the display frame based on the lower digits of the tone data of the display frame and lower digits of the tone data of the immediately preceding frame, and generates the correction tone data by adding the converted upper digits and the converted lower digits of the tone data of the display frame.

According to this arrangement, by adding the remaining lower digits of the tone data after the conversion, even less error is incurred.

[Third Embodiment]

The following will describe the Third Embodiment of the present invention with reference to FIG. 20 through FIG. 25. An active-matrix liquid crystal display device of the present embodiment has a structure which is basically the same as that described in the First Embodiment based on FIG. 1, and only differences from the First Embodiment are described below. The active-matrix liquid crystal display device according to the present embodiment includes a converter,/arithmetic circuit 40 instead of the LUT memory 32.

Conversion into appropriate tone data only by simple calculations based on the display frame tone data and the preceding frame tone data is difficult. This is because the calculations for conversion need to take into account (a) the voltage (Vm in Equation (4)) to be applied across the electrodes of the liquid crystal cell 22 according to a tone to be displayed and (b) a capacitance ratio (Cm/Cn in Equation (4)) across the electrodes of the liquid crystal cell 22 which is associated with a tone change from the preceding display to the current display, where values of (a) and (b) cannot be equated by simple functions expressing tones.

Therefore, the converter/arithmetic circuit 40 of the present embodiment, using a table for converting the tone data into values which correspond to a voltage and capacitance across the electrodes of the liquid crystal cell 22, performs calculations with respect to the result of this conversion and re-converts the result of calculations to corresponding tone data. This process enables creating the correction tone data by simple conversion and calculation.

Figure 20:
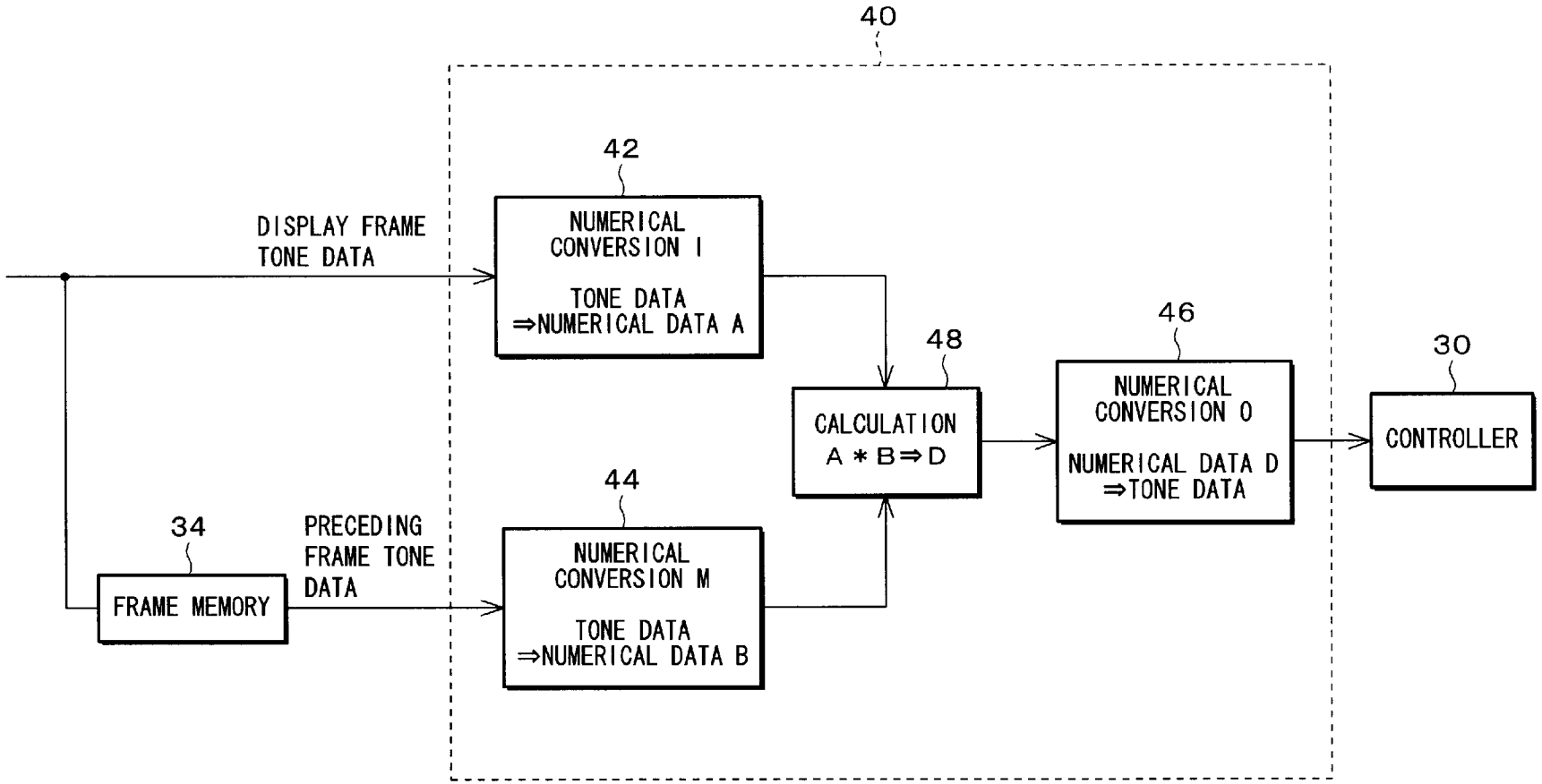
FIG. 20 is a block diagram showing a structure around a converter/arithmetic circuit according to the Third Embodiment of the present invention.

FIG. 20 is a block diagram showing a structure around the converter/arithmetic circuit 40 according to the present embodiment. The converter/arithmetic circuit 40 includes first through third LUT memories 42, 44, 46, and an arithmetic section 48. In the converter/arithmetic circuit 40, the display frame tone data and the preceding frame tone data are inputted to the first LUT memory 42 and the second LUT memory 44, respectively. The first LUT memory 42 and the second LUT memory 44 store pre-defined numerical data which correspond to the tones of the display frame tone data and the preceding frame tone data, respectively, and output the corresponding numerical data of the inputted tone data. That is, the first LUT memory 42 and the second LUT memory 44 convert the respective inputted data into corresponding pre-defined numerical data. In the following, the conversion by the first LUT memory 42 and the conversion by the second LUT memory 44 will be called numerical conversion I and numerical conversion M, respectively. The numerical data as a result of numerical conversion I and numerical conversion M will be generally referred to as numerical data A and numerical data B, respectively. The respective outputs, numerical data A and numerical data B, of the first LUT memory 42 and the second LUT memory 44 are inputted to the arithmetic section 48. The arithmetic section 48 performs a simple calculation of numerical data A and numerical data B, such as a calculation of four rules. The numerical data as a result of this calculation will be generally referred to as numerical data D. The output, numerical data D, of the arithmetic section 48 is inputted to the third LUT memory 46. The third LUT memory 46 stores pre-defined correction tone data which corresponds to numerical data D from the arithmetic section 48, and outputs the correction tone data corresponding to the inputted numerical data D to the controller 30. That is, the third LUT memory 46 converts the inputted numerical data D into corresponding pre-defined correction tone data. In the following, the conversion by the third LUT memory 46 will be referred to as numerical conversion 0.

Note that, "A*B" indicates various calculations between numerical data A and numerical data B.

An example of these conversion and calculation is described below. In liquid crystal display devices of the active-matrix variety, as described in the BACKGROUND OF THE INVENTION section, the voltage of the liquid crystal cell 22 is varied (voltage drop or voltage rise) as a result of a change in dielectric constant of the liquid crystal in the liquid crystal cell 22 when changing the displayed tone. Thus, a tone voltage which is suitable to the tone to be displayed cannot be applied. As explained above, it is difficult in the liquid crystal display device of the active-matrix variety to express the following variables (a) and (b) by simple functions: (a) the voltage (Vm in Equation (4)) to be applied across the electrodes of the liquid crystal cell 22 according to the tone to be displayed and (b) a capacitance ratio (Cm/Cn in Equation (4)) across the electrodes of the liquid crystal cell 22 which is associated with a tone change from the preceding display to the current display. Therefore, it is difficult to properly perform the conversion by calculations directly using the tone data.

Thus, in the present embodiment, the tone data are once converted into numerical values which reflect the voltage or capacitance of the liquid crystal cell 22. In order to perform this conversion, the first LUT memory 42 and the second LUT memory 44 store in advance numerical data which correspond to respective tones of the display frame tone data and the preceding frame tone data. In this way, the first LUT memory 42 and the second LUT memory 44 can be referred to based on the inputted display frame tone data and the preceding frame tone data, so as to obtain corresponding numerical data.

The numerical data to be stored in the first LUT memory 42 and the second LUT memory 44 are determined as follows. It is assumed here that the tone indicated by the display frame tone data is m, and the tone indicated by the preceding frame tone data is n. Also, the voltage and capacitance of the liquid crystal cell 22 displaying tone m in a constant state are Vm and Cm, respectively, and the capacitance of the liquid crystal cell 22 displaying tone n in a constant state is Cn. These variables can be related to each other as follows as in Equation (4) to find voltage Vp (corrected voltage) which is required for the liquid crystal cell 22 to change tones from tone n to tone m $$Vp=Cm/Cn\times Vm \quad (5).$$

Further, the numerical data Am stored in the look-up table of the first LUT memory 42 with respect to tone m is $Am=\alpha\times Vm\times Cm$, and the numerical data stored in the look-up table of the second LUT memory 44 with respect to tone n is $Bn=1/Cn\times\beta$. Here, $\alpha$ and $\beta$, which will be explained later, are predetermined constants. The calculation performed by the arithmetic section 48 is the multiplication of numerical data Am and numerical data Bn. That is, the arithmetic section 48 makes up a multiplier. The result of calculation can be expressed in terms of numerical data Dp by $Dp=\alpha\times\beta\times Vp$. Further, the tone indicated by the correction tone data which is stored in the third LUT memory 46 as the look-up table is tone P with respect to numerical data Dp. Tone P is used to apply voltage Vp to the liquid crystal cell 22 via the controller 30.

That is, the converter/arithmetic section 40 carries out conversion of tone data by the following sequence of conversions and calculations $$m \rightarrow Vm, Cm \quad (6)$$

$$n \rightarrow Cn \quad (7)$$

$$Am \leftarrow (Vm \times Cm) \times \alpha \quad (8)$$

$$Bn \leftarrow (1/Cn) \times \beta \quad (9)$$

$$Dp = Am \times Bn \quad (10)$$

$$P \leftarrow Dp \quad (11).$$

Here, the conversions of Equations (6) and (8) are carried out in the first LUT memory 42, those of Equations (7) and (9) in the second LUT memory 44, that of Equation (10) in the arithmetic section 48, and that of Equation (11) in the third LUT memory 46. Note that, in Equations (6) through (11), "→" or "←" indicates conversion using the look-up table, and "=" indicates calculation. Also, Equations (8) and (9) shown as conversions using the look-up table may be calculations. Further, Equations (6) and (7) may also be calculations, but conversions are preferable since these calculations are expected to be complex.

Figure 21:
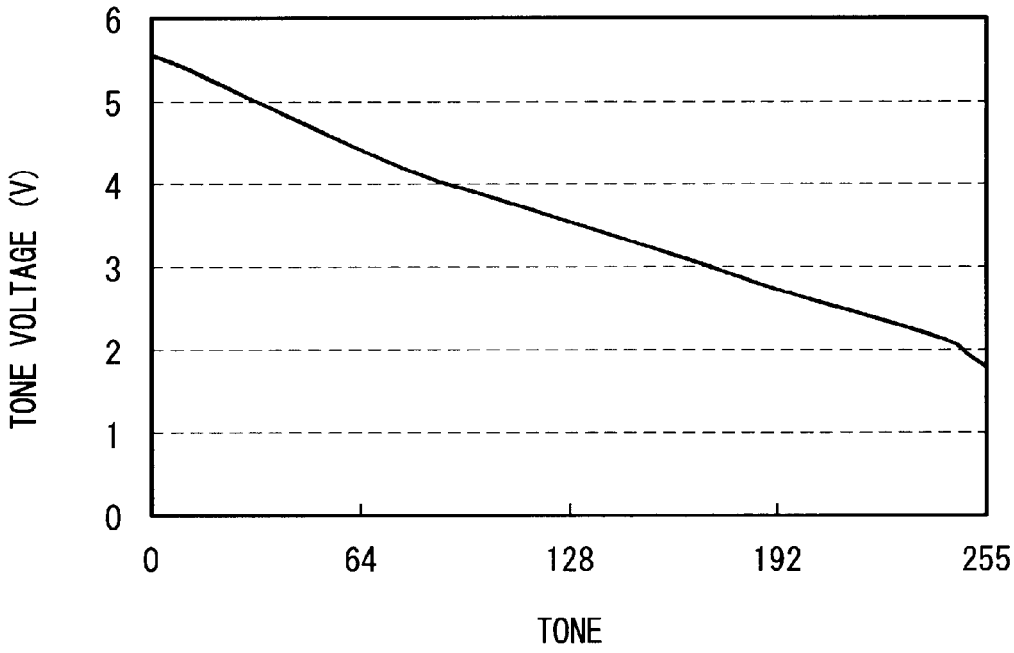
FIG. 21 is a graph showing a relationship between tone and tone voltage in a constant state of a liquid crystal panel used in the Third Embodiment.
Figure 22:
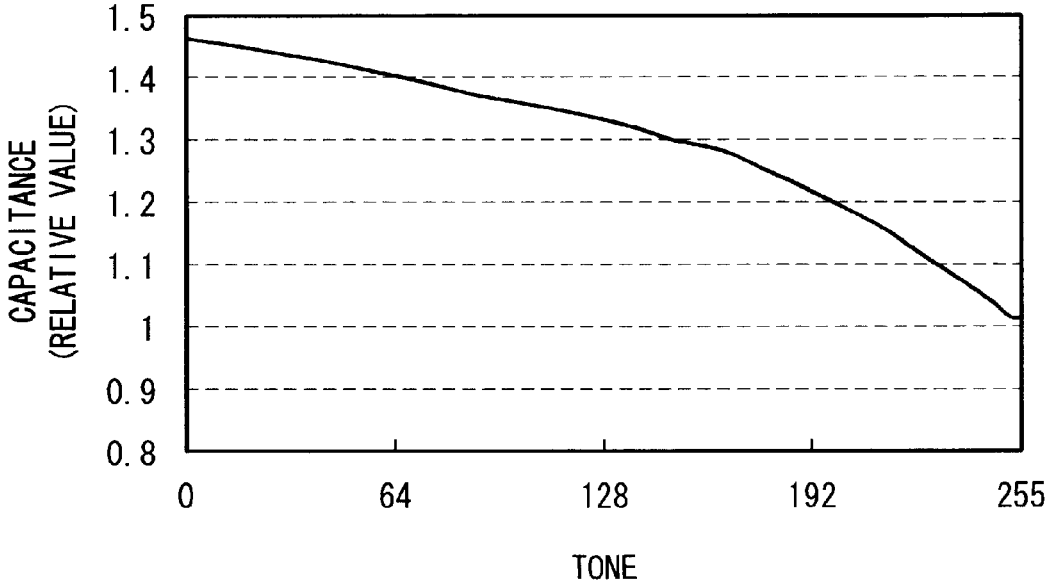
FIG. 22 is a graph showing a relationship between tone and capacitance of a liquid crystal cell in a constant state of a liquid crystal panel used in the Third Embodiment.

The following explains the foregoing conversions and calculations in more detail. Note that, the liquid crystal panel 10 used herein has the characteristics as shown in FIG. 21 and FIG. 22. FIG. 21 is a graph showing a relationship between tone and tone voltage in a constant state of the liquid crystal panel 10 used in the present embodiment. FIG. 22 is a graph showing a relationship between tone and capacitance (relative value) of the liquid crystal cell 22 in a constant state of the liquid crystal panel 10 used in the present embodiment.

Vm and Cm are real numbers as read out from FIG. 21 and FIG. 22, and are not suitable for digital calculations. It is therefore necessary to multiply these values to prevent errors due to rounding off. Here, numerical data Am corresponds to the product of Vm×Cm, and the minimum difference between tones of this value is 0.00848. Thus, in order to eliminate this error, for example, the product of Vm×Cm is multiplied 120 times to bring the minimum difference to a value close to 1. Further, numerical data Bn corresponds to the value of 1/Cn, and the minimum difference between tones of this value is 0.000124. Thus, in order to eliminate this error, for example, 1/Cn is multiplied 8070 times to bring the minimum difference to a value close to 1. In this case, $\alpha$=120, and $\beta$=8070.

The values of $\alpha$ and $\beta$ need not be strict, and do not cause serious errors even when the minimum difference is less than 1 and numerical value Am or Bn takes the same value between adjacent tone data. Further, as in the Second Embodiment, in many cases, the effect of correction will be sufficient even when the lower bits are not considered. This is because an error as small as 4 tones does not have any significant influence on display and does not pose any problem in actual applications as explained above.

Thus, when $\alpha$=120 and $\beta$=8070 as above, the foregoing Equations (5) and Equations (8) through (10) give $$Am = 120 \times Cm \times Vm$$

$$Bn = 8070 \times (1/Cn)$$

$$Dp = Am \times Bn = 8070 \times 120 \times Vp$$

Note that, in calculations of values of Am, Bn, and Dp based on these equations, the values are rounded off to the decimal point.

In this case, the values of the graphs of FIG. 21 and FIG. 22 give numerical data Am in a range of 964 (m=0) to 219 (m=255), inclusive, and numerical data Bn in a range of 5523 (n=0) to 7926 (n=255), inclusive These values may be used directly, but the memory space can be reduced by setting smaller values by shifting the numerical data. That is, it is preferable to use values which are obtained by shifting numerical data Bn as follows $$Bn = 8070 \times (1/Cm) - 5523$$

$$Dp = Am \times (Bn + 5523) - 1209537$$

so that the minimum value of numerical data Bn becomes 0. This reduces the memory space of the second LUT memory 44. Note that, it is also possible to shift numerical data Am as with numerical data Bn so that its minimum value becomes 0. However, while the memory space required for the numerical data Am is in a range of 964 (m=0) and 219 (m=255), inclusive, which is equivalent of 10 bits, it remains the same even when shifted to a range of 745 (m=0) to 0 (m=255), inclusive. Therefore, it is not particularly required to shift numerical data Am since the memory space will not be changed.

Here, shown by graphs of FIG. 23 through FIG. 25 are relationships between display frame tone data and numerical data Am, between preceding frame tone data and numerical data Bn, and between numerical data Dp and tone data P.

In order to allow use of smaller memory space for the first through third LUT memories 42, 44, and 46 which store numerical data Am, Bn, and Dp, respectively, the first LUT memory 42 and the second LUT memory 44 may perform conversions based on, for example, only the upper 6 bits of the display frame tone data and preceding frame tone data as in the Second Embodiment. This can be carried out without essentially losing the effect of correction.

As described, in the present embodiment, the converter/arithmetic circuit 40 which makes up the converter converts the display frame tone data into the correction tone data based on the display frame tone data and the preceding frame tone data. Here, the converter/arithmetic circuit 40 stores beforehand numerical data A (first conversion value) which is specified by the display frame tone data, and numerical data B (second conversion value) which is specified by the preceding frame tone data. Further, the converter/arithmetic circuit 40 generates correction tone data by calculations based on numerical data A and numerical data B which are specified in this manner.

Thus, in the process of generating correction tone data from the display frame tone data and the preceding frame tone data, those processes which require complex calculations are performed by conversion into pre-stored numerical data A and B, and those which can be processed by simple calculations are carried out by calculations. Thus, complex calculations, which could result when all the processes were carried out by calculations, can be avoided, and the structure of the converter/arithmetic circuit 40 can be simplified. Further, it is possible to suppress increase in memory space which occurs when correction tone data which correspond to all combinations of tone changes (combinations of tones indicated by display frame tone data and preceding frame tone data) are stored, thus simplifying the converter/arithmetic circuit 40.

As described, the liquid crystal display device of the present invention carries out tone display with pixels by applying a tone voltage according to tone data to each pixel in each frame, and includes: a converter for converting tone data of a display frame to correction tone data based on the tone data of the display frame and tone data of an immediately preceding frame; a driver for applying the tone voltage to the pixels based on the correction tone data obtained in the converter; and a liquid crystal cell, which makes up the pixels, for realizing tone display by the applied zone voltage, wherein: the converter stores beforehand a first conversion value which corresponds the tone data of the display frame and a second conversion value which corresponds to the tone data of the immediately preceding frame, and the converter generates the correction tone data based on a result of calculation using the first conversion value and the second conversion value corresponding to the tone data of the display frame and the tone data of the immediately preceding frame, respectively.

The converter converts the tone data of the display frame to reduce a mismatch between tone data and the actual tone displayed on the liquid crystal cell due to a change in electric capacitance of the liquid crystal cell of a pixel caused by a change in tone voltage applied to this pixel. Specifically, when the tone indicated by the tone data of the display frame is higher than the tone indicated by the tone data of the immediately preceding frame, the converter converts the tone data of the display frame so as to increase the tone indicated by the tone data of the display frame, and when the tone indicated by the tone data of the display frame is lower than the tone indicated by the tone data of the immediately preceding frame, the converter converts the tone data of the display frame so as to reduce the tone indicated by the tone data of the display frame.

[Fourth Embodiment]

The following describes the Fourth Embodiment of the present invention. An active-matrix liquid crystal display device according to the present embodiment has basically the same structure as that described based on FIG. 20 in the Third Embodiment. What is different from the Third Embodiment is the actual processes of conversions and calculations.

In the present embodiment, the foregoing Equation (5) is modified as follows $$\mathrm{Log}(Vp)=\mathrm{Log}(Cm/Cn\times Vm)=\mathrm{Log}(Cm\times Vm)-\mathrm{Log}(Cn) \quad (12).$$

Logarithms of Equation (5) were taken on both sides this way to allow the arithmetic section 48 to perform calculations not by multiplication but by subtraction, which is simpler than multiplication. Thus, the logarithm may be either common logarithm or natural logarithm. Here, when $$Am=\gamma\times\mathrm{Log}(Cm\times Vm) \quad (13)$$

$$Bn=\gamma\times\mathrm{Log}(Cn) \quad (14)$$

$$Dp=\gamma\times\mathrm{Log}(Vp) \quad (15)$$

where $\gamma$ is a predetermined constant which is set to prevent rounding off in digital conversion as with constant $\alpha$ and $\beta$ in the Third Embodiment, then $$Dp=Am-Bn \quad (16).$$

That is, the converter/arithmetic circuit 40 converts tone data by the following conversions and calculations $$\mathrm{m}\rightarrow\mathrm{Vm,\ Cm} \quad (17)$$

$$\mathrm{n}\rightarrow\mathrm{Cn} \quad (18)$$

$$\mathrm{Am}\leftarrow\gamma\times\mathrm{Log}(\mathrm{Vm}\times\mathrm{Cm}) \quad (19)$$

$$\mathrm{Bn}\leftarrow\gamma\times\mathrm{Log}(\mathrm{Cn}) \quad (20)$$

$$Dp=Am-Bn \quad (21)$$

$$\mathrm{P}\leftarrow\mathrm{Dp} \quad (22).$$

Here, the conversions of Equations (17) and (19) are performed by the first LUT memory 42, those of Equations (18) and (20) by the second LUT memory 44, and that of Equation (21) by the arithmetic section 48, and that of Equation (22) by the third LUT memory 46. Thus, the arithmetic section 48 makes up a subtractor. Note that, in Equations (17) through (22), "→" or "←" indicates conversion using the look-up table, and "=" indicates calculation. Also, Equations (19) and (20) shown as conversions using the look-up table may be calculations. Further, Equations (17) and (18) may also be calculations, but conversions are preferable since these calculations are expected to be complex.

Note that, in order to realize digital conversion of tone m of the display frame tone data into numerical data Am, numerical data Am need to take digital values. Thus, constant $\gamma$ is set so that the value of numerical data Am takes an integer value (digital value) as in the Third Embodiment.

The following examines numerical data Am and numerical data Bn to explain conditions for setting numerical data Am and numerical data Bn with respect to common liquid crystal cell 22.

First:, in order to examine numerical data Am and numerical data Bn, the following considers a simplistic case where numerical data Am and numerical data Bn change linearly (one dimensionally) with respect to tone m and tone n which are indicated by the display frame tone data and the preceding frame tone data, respectively. For example, the following equation of tone P which indicates correction tone data is considered $$P=m+a\times(m-n) \quad (23).$$

In this case, irrespective of the tone indicated by the display frame tone data, tone P, which is indicated by correction tone data after the conversion, takes a value which is obtained by adding tone m indicated by the display frame tone data to the product of constant a×a difference (m−n) between tones due to the tone change. In the following, a×(m−n) will be referred to as the "load". In this case, the following equations are established $$Am=(1+a)\times m \quad (24)$$

$$Bn=a\times n \quad (25)$$

$$\mathrm{P}=\mathrm{Dp} \quad (26).$$

The following considers function A(m) which equates tone m, indicated by the display frame tone data, and numerical data Am; and function B(n) which equates tone n, indicated by the preceding frame tone data, and numerical data Bn.

First, numerical data Am is considered. In order to change the load, a constant a needs to be changed. This is accomplished by changing a slope of function A(m) using Equation (24). Thus, where tone m indicated by the display frame tone data requires a large load with respect to a tone change from the preceding frame tone data, the absolute value of the slope of function A(m) is increased, whereas where a small load is required with respect to a tone change from the preceding frame tone data, the absolute value of the slope of function A(m) is decreased. Here, the slope is referred to in terms of "absolute value" because the slope of function A(m) can take either a positive value or a negative value, depending on display characteristics of the liquid crystal cell 22. Specifically, when the liquid crystal cell 22 is in a normally white mode, the slope of function A(m) becomes negative, whereas the slope becomes positive when the liquid crystal panel 10 is in a normally black mode.

In reality, however, function A(m) is expected to change non-linearly, rather than linearly. Thus, where tone m indicated by the display frame tone data requires a large load, numerical data A(m) is set so that the slope of function A(m) is increased, whereas where a small load is required, numerical data Am is set so that the slope of function A(m) is decreased.

Further, at the same tone q (m=n=q), the absolute value of the slope of function A(q) is required to be always larger than the absolute value of the slope of function B(q). This is because when function A(q) and function B(q) have the same absolute value of slopes, the tone indicated by correction tone data of still image display at tone q (m=n=q) and that of still image display at tone (q+1) (m=n=(q+1)) take the same value and tones of these still images degrade. Another reason is that the tones are reversed when the absolute value of the slope of function A(q) is smaller than the absolute value of the slope of function B(q).

Further, it is required that the absolute value of the slope of function A(q) be not less than 1. Numerical data Am is digital data, and values less than 1 become 0. This is required because tones of still images also degrade as with the foregoing case when the slope of function A(q) becomes 0.

Therefore, it is required that the value of numerical data Am be larger than the value of display frame tone data m, and larger than at least about four times (equivalent of 2 bits) the display frame tone data.

The absolute value of the slope of function A(m) is required to be at least 1 and always larger than the absolute value of the slope of function B(q). Here, depending on tones, there are cases where it may be necessary to increase the proportion of contribution to the correction by numerical data Bn by increasing the degree of change of numerical data Bn, i.e., the absolute value of the slope of function B(q), so that the absolute value of the slope becomes 2 or 3, for example. Thus, there are cases where the absolute value of the slope of function A(m) needs to be about 4. That is, the change of numerical data Am may be required to be about four times (equivalent of 2 bits) the change of the display frame tone data. Once the absolute value of the slope of function A(m), i.e., a state of change of numerical data Am is decided, A0 (numerical data Am with respect to tone m=0 of the display frame tone data) and Amax (numerical data Am with respect to the maximum value (m=255 in 8 bits) of tone m of the display frame tone data) are decided according to the characteristics of the liquid crystal cell 22.

The following considers numerical data Bn. It can be seen from Equation (25) that numerical data Bn also determines the load with respect to the preceding frame tone data. The absolute value of the slope of function B(n) is required to be smaller than the absolute value of the slope of function A(m) as described above.

Further, considering still image display at tone q (m=n=q), when $$Dq=Aq-Bq \quad (27),$$

the tone which is indicated by the correction tone data after the conversion, corresponding to numerical data Dq which is equated by Equation (22), needs to be tone q. This is because displayed tones in a still image display do not match otherwise.

As described, there is a correlation between the absolute value of the slope of function A(m) and the absolute value of the slope of function B(n) and therefore the maximum value of numerical data Am is decided according to the degree of change of numerical data Bn. Further, the minimum value of numerical data Am is required to be larger than the maximum value of numerical data Bn without giving a negative value to numerical data Dp in Equation (21). Thus, numerical data Am and numerical data Bn take values which are correlated to each other.

By thus setting numerical data Am and numerical data Bn taking into consideration the foregoing conditions, it is not necessarily required to determine characteristics of the liquid crystal cell 22 by experiment. However, numerical data Am and numerical data Bn cannot be decided definitively even when these conditions are taken into consideration, and thus numerical data Am and numerical data Bn need to be set while checking the actual display state.

Figure 26:
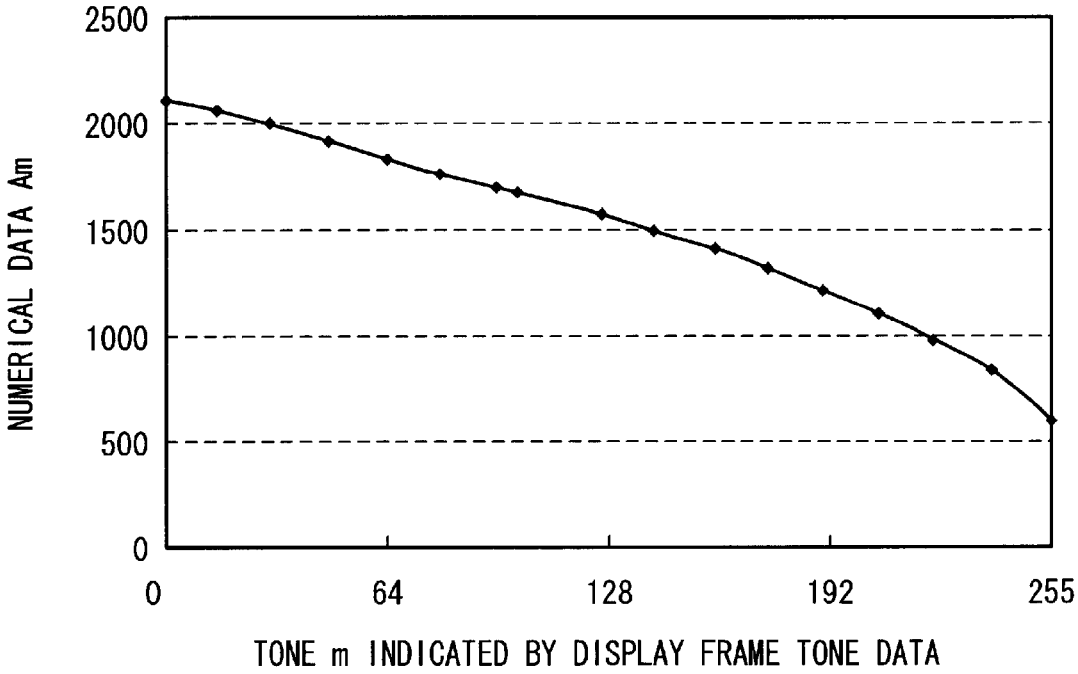
FIG. 26 is a table showing a relationship between display frame tone data and numerical data in the Fourth Embodiment of the present invention.
Figure 27:
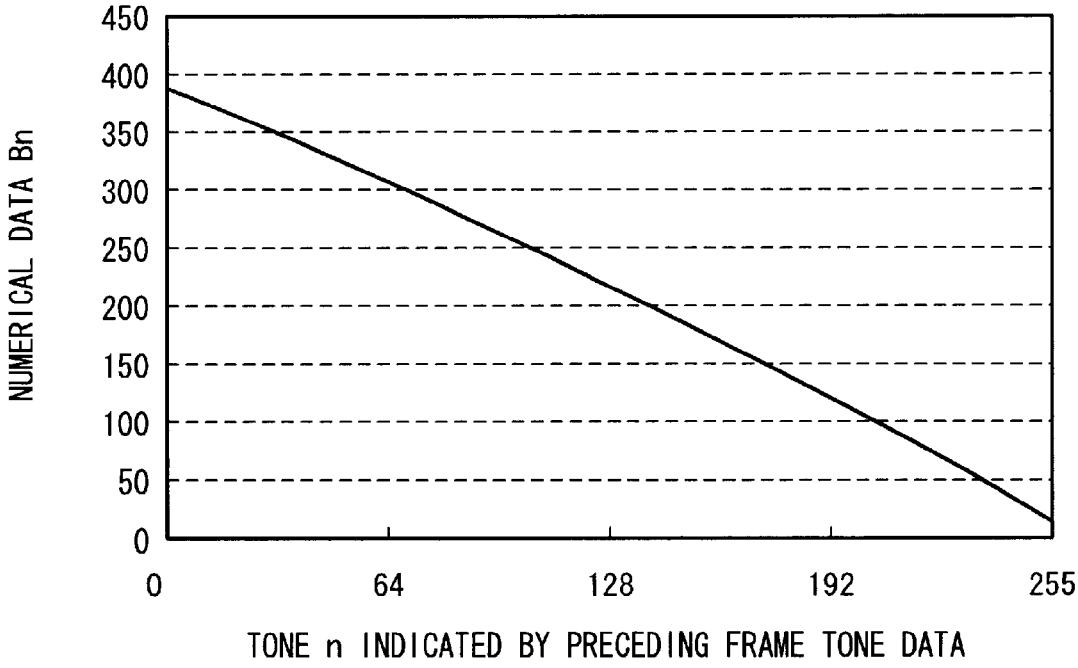
FIG. 27 is a table showing a relationship between preceding frame tone data and numerical data in the Fourth Embodiment of the present invention.
Figure 28:
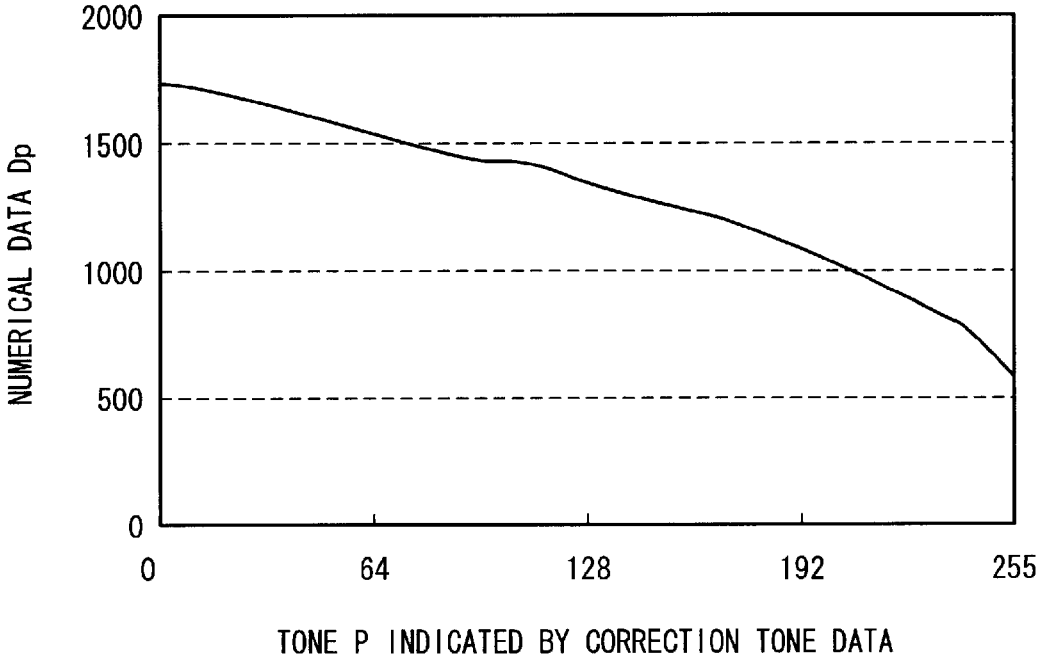
FIG. 28 is a table showing a relationship between numerical data and correction tone data in the Fourth Embodiment of the present invention.

FIG. 26 through FIG. 28 are exemplary graphs of the liquid crystal panel 10 having the characteristics of FIG. 21 and FIG. 22, showing a relationship between tone m indicated by the display frame tone data and numerical data Am, between tone n indicated by the preceding frame tone data and numerical data Bn, and between numerical data Dp and tone P indicated by the correction tone data after conversion.

As described, in the present embodiment, as in the Third Embodiment, the converter/arithmetic circuit 40 which makes up the converter converts the display frame tone data into the correction tone data based on the display frame tone data and the preceding frame tone data. Here, the converter/arithmetic circuit 40 store beforehand numerical data A (first conversion value) which is specified by the display frame tone data and numerical data B (second conversion value) which is specified by the preceding frame tone data. Further, the converter/arithmetic circuit 40 generates the correction tone data by calculations based on these numerical data A and numerical data B.

In this way, the same effects as those described in the Third Embodiment can be obtained. In addition, in the present embodiment, the arithmetic section 48 can make up a substractor, thus providing a simpler structure for the converter/arithmetic circuit 40.

[Fifth Embodiment]

Figure 29:
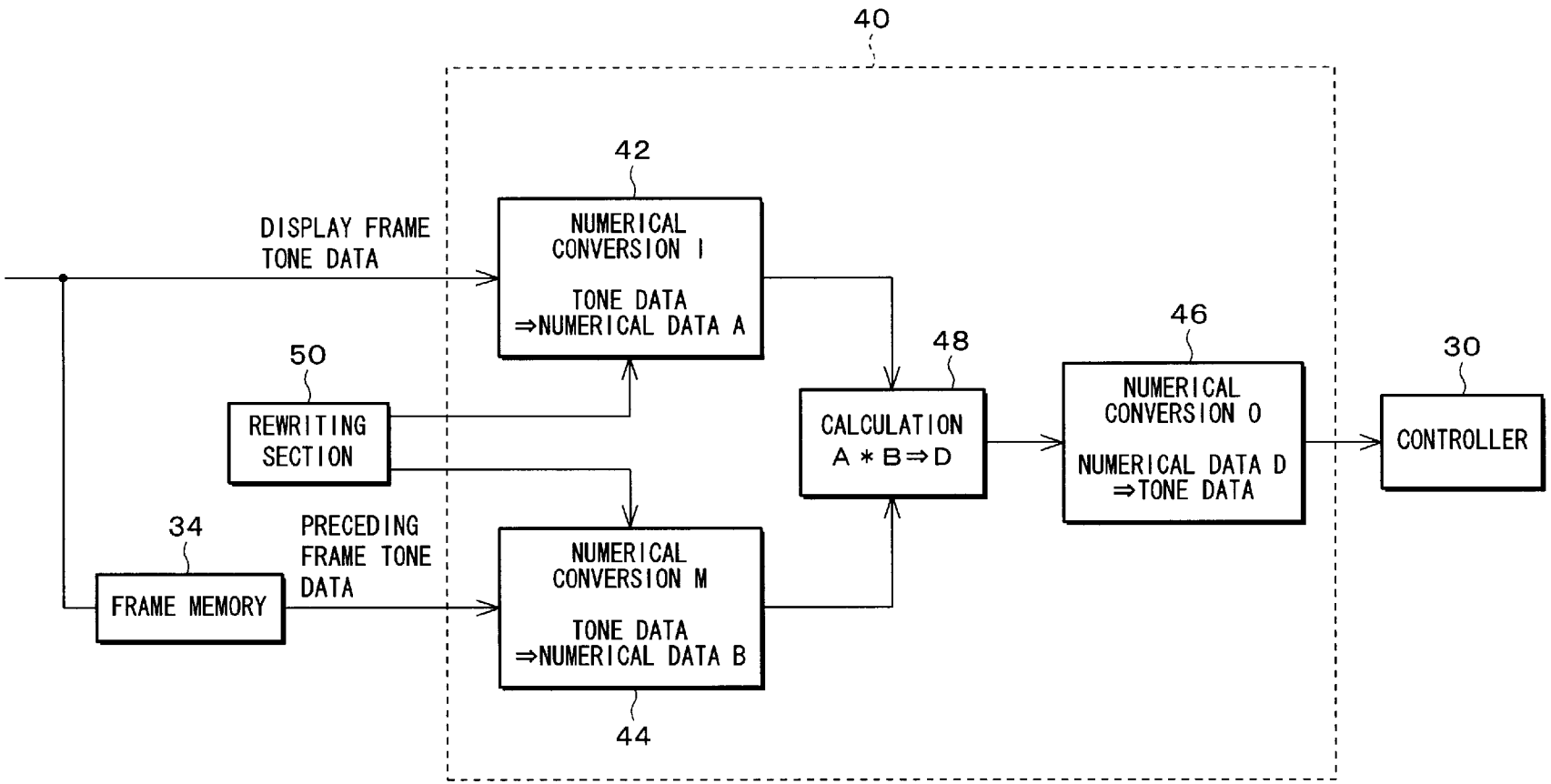
FIG. 29 is a block diagram showing a structure around a converter/arithmetic circuit according to the Fifth Embodiment of the present invention.

The following will describe a Fifth Embodiment of the present invention with reference to FIG. 29. An active-matrix liquid crystal display device of the present embodiment has a structure which is basically the same as those described in the Third and Fourth Embodiments based on FIG. 20, and only differences from the Third and Fourth Embodiments are described here.

The active-matrix liquid crystal display device according to the present embodiment further includes a rewriting section 50. The rewriting section 50 enables rewriting a group of numerical data A and a group of numerical data B which are stored in the first LUT memory 42 and the second LUT memory 44, respectively, in the converter/arithmetic circuit 40.

These rewritable groups of the respective numerical data of the first LUT memory 42 and the second LUT memory 44 allow the converter/arithmetic circuit 40 to adapt to different characteristics of various liquid crystal panels 10, thereby making the converter/arithmetic circuit 40 versatile.

The rewriting section 50 only needs to rewrite at least one of the group of numerical data A and the group of numerical data B. This allows the converter/arithmetic circuit 40 to adapt to, for example, various characteristics of the same type of liquid crystal panel 10 due to individual differences, thus optimizing a displayed state.

In order to be more adaptive to a wider range of liquid crystal panels 10 with different display modes, different liquid crystal materials, and different panel designs, etc., it is preferable to have the both groups rewritable to obtain a wider adaptive range.

As described, it is preferable that the converter,/arithmetic circuit 40 which makes up the converter is adapted so that at least one of (a) a group of stored numerical data A (group of first conversion values) and (b) a group of stored numerical data B (group of second conversion values) is externally rewritable.

Note that, as to numeric conversions I, M, O, or the actual manner the calculation A*B⋆D is carried out, those described either in the Third Embodiment or the Fourth Embodiment may be used.

As described, it is preferable in the liquid crystal display device of the present embodiment, in the liquid crystal display device which stores the first conversion value and the second conversion value in the converter, that the converter is adapted so that at least one of a group of first conversion values and a group of second conversion values stored therein is externally rewritable.

According to this arrangement, by the externally rewritable groups of first and second conversion values stored in the converter, various liquid crystal panels with liquid crystal cells of different characteristics can be flexibly used. That is, by rewriting the group of first conversion values and the group of second conversion values, correction tone data according to characteristics of the liquid crystal cell can be generated.

[Sixth Embodiment]

Figure 30:
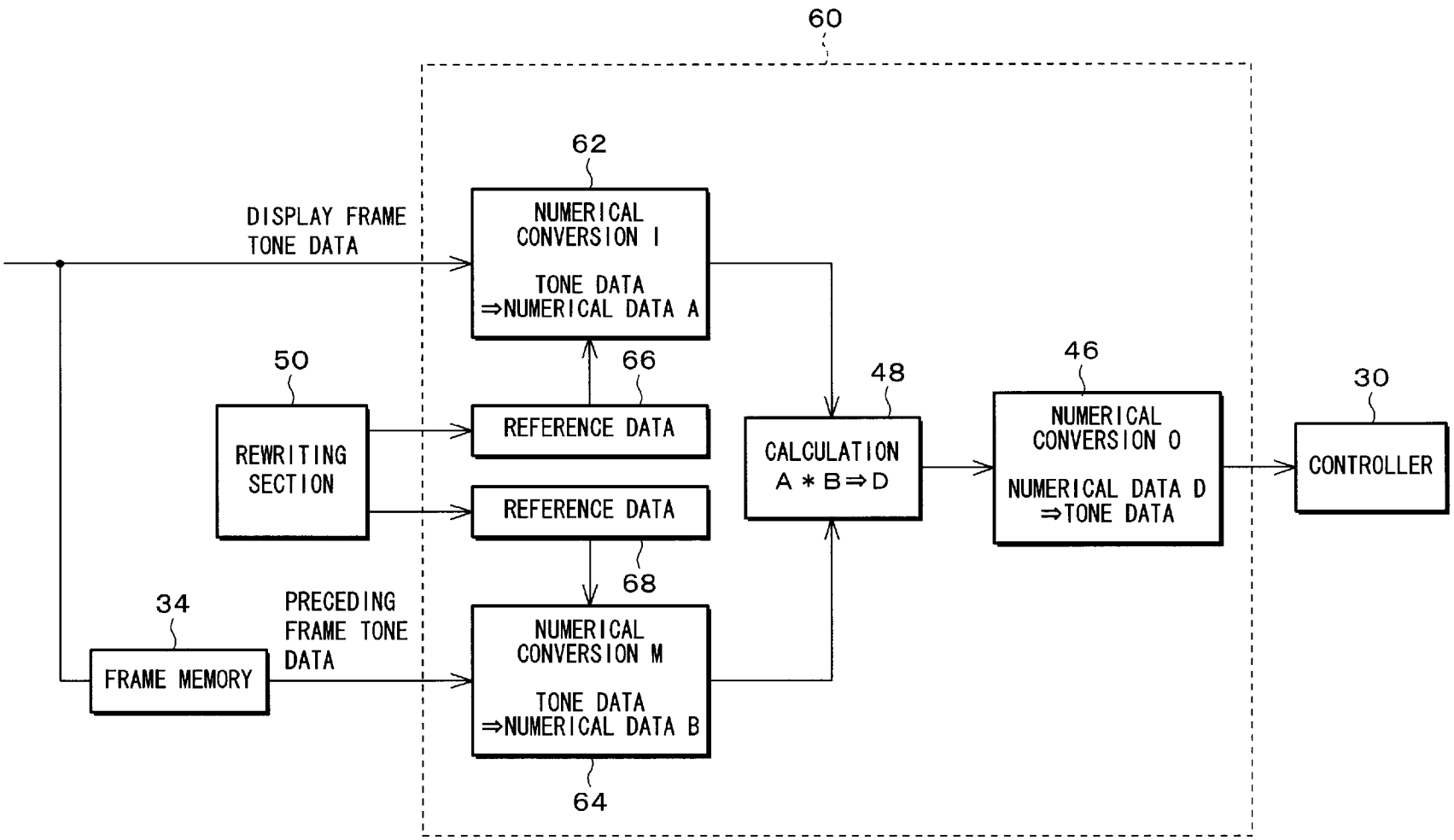
FIG. 30 is a block diagram showing a structure around a converter/arithmetic circuit according to the Sixth Embodiment of the present invention.

The following will describe the Sixth Embodiment of the present invention with reference to FIG. 30. An active-matrix liquid crystal display device of the present embodiment has a structure which is basically the same as those described in the Third and Fourth Embodiments based on FIG. 20, and only differences from the Third and Fourth Embodiments are described here.

The active-matrix liquid crystal display device according to the present embodiment is provided with a converter/arithmetic circuit 60 which is equivalent to the converter/arithmetic circuit 40 of FIG. 20, and includes therein: a first interpolating section 62 and the first reference data memory 66, which are provided instead of the first LUT memory 42; and a second interpolating section 64 and a second reference data memory 68, which are provided instead of the second LUT memory 44. The first interpolating section 62 and the second interpolating section 64 are adapted to receive reference data (described later) respectively from the first reference data memory 66 and the second reference data memory 68.

The converter/arithmetic circuit 60, instead of storing all sets of numerical data Am and numerical data Bm of the respective tones, calculates numerical data Am and numerical data Bm of the respective tones by interpolation in the first interpolating section 62 and the second interpolating section 64 based on reference data, wherein the reference data are numerical data Am and numerical data Bm of predetermined tones of certain intervals which are stored beforehand in the first reference data memory 66 and the second reference data memory 68, respectively. That is, upon input of the display frame tone data or preceding frame tone data, the numerical data Am or numerical data Bm which was calculated by interpolation in the first interpolating section 62 or the second interpolating section 64 is used to carry out numerical conversion I or numerical conversion M.

The reference data, when it is set, for example, for every 16 tones, become numerical data Am or numerical data Bm which corresponds to tone 0, tone 16, tone 32, . . . , tone 240, and tone 255. The numerical values of numerical data Am and numerical data Bm which correspond to tones between their respective reference data can be obtained, for example, by linear interpolation of these reference data. For example, numerical data Am which corresponds to tone m (0<m<16) can be obtained from $$Am = A0 + (A16 - A0)/16 \times m$$

where A0 and A16 are numerical data Am which correspond to tone 0 and tone 16, respectively.

Further, it is preferable that a rewriting section 50 is provided as in the Fifth Embodiment so that at least one of (a) the group of reference data in the first reference data memory 66 and (b) the group of reference data in the second reference data memory 68 can be over-written externally by the rewriting section 50. This allows the converter/arithmetic circuit 60 to adapt to liquid crystal panels 10 of various characteristics, thus providing converter/arithmetic circuit 60 that is more versatile.

As described, in the present embodiment, as in the Third and Fourth Embodiments, the converter/arithmetic circuit 60 which makes up the converter converts the display frame tone data into correction tone data based on the display frame tone data and the preceding frame tone data. In this instance, the converter/arithmetic circuit 60 stores beforehand reference data (first reference value) which is specified by the display frame tone data, and reference data (second reference value) which is specified by the preceding frame tone data. Further, the converter/arithmetic circuit 60 calculates numerical data A (first conversion value) and numerical data B (second conversion value) by performing interpolation based on their respective reference data. Further, the converter/arithmetic circuit 60 generates correction tone data by calculation based on numerical data A and numerical data B thus specified.

In this way, it is not required to store all sets of numerical data A and numerical data B of the respective tones, thus reducing memory space required for the converter/arithmetic circuit 60. Note that, since the calculation of interpolation is relatively simple, the first interpolation section 62 and the second interpolation section 64 can be realized by a relatively simple circuit structure. Thus, the first interpolation section 62 and the second interpolation section 64 do not result in a complex circuit structure.

Note that, as to numerical conversions I, M, 0, or the actual manner the calculation A*B⋆D is carried out, those described either in the Third Embodiment or the Fourth Embodiment may be used.

As described, the liquid crystal display device of the present embodiment carries out tone display with pixels by applying a tone voltage according to tone data to each pixel in each frame, and includes: a converter for converting tone data of a display frame to correction tone data based on the tone data of the display frame and tone data of an immediately preceding frame; a driver for applying the tone voltage to the pixels based on the correction tone data obtained in the converter; and a liquid crystal cell, which makes up the pixels, for realizing tone display by the applied tone voltage, wherein: the converter stores beforehand a first reference value for calculating the first conversion value which corresponds to the tone data of the display frame and a second reference value for calculating the second conversion value which corresponds to the tone data of the immediately preceding frame, and the converter calculates the first conversion value and the second conversion value by interpolation based on the first reference value and the second reference value, respectively, and generates the correction tone data based on a result of calculation using the first conversion value and the second conversion value corresponding to the tone data of the display frame and the tone data of the immediately preceding frame, respectively.

The converter converts the tone data of the display frame to reduce a mismatch between tone data and the actual tone displayed on the liquid crystal cell due to a change in electric capacitance of the liquid crystal cell of a pixel caused by a change in tone voltage applied to this pixel. Specifically, when the tone indicated by the tone data of the display frame is higher than the tone indicated by the tone data of the immediately preceding frame, the converter converts the tone data of the display frame so as to increase the tone indicated by the tone data of the display frame, and when the tone indicated by the tone data of the display frame is lower than the tone indicated by the tone data of the immediately preceding frame, the converter converts the tone data of the display frame so as to reduce the tone indicated by the tone data of the display frame.

It is preferable in the liquid crystal display device of the present embodiment, in the liquid crystal display device which stores the first conversion value and the second conversion value in the converter, that the converter is adapted so that at least one of (a) a group of first reference values and (b) a group of second reference values stored therein is externally rewritable.

According to this arrangement, various liquid crystal panels with liquid crystal cells of different characteristics can be flexibly used as in the foregoing case.

[Seventh Embodiment]

The following will describe the Seventh Embodiment of the present invention with reference to FIG. 34 through FIG. 39.

In the liquid crystal display device according to the present embodiment, it is preferable to take into consideration a reduction in memory space of the LUT memory or frame memory because it is associated with a reduction in chip size (or the number of pins) of the controller. As described, the Second Embodiment discloses the arrangement by which the only the upper bits of the tone data are converted by the LUT memory 36 (FIG. 16), and the Third, Fifth, and Sixth Embodiments disclose the arrangement by which memory space of the LUT memory can be reduced by the provision of the arithmetic section 48 (FIG. 20, FIG. 29, and FIG. 30).

The present embodiment reduces memory space of the LUT memory or frame memory by reducing the number of conversion bits as in the Second Embodiment, and converts the tone data which is inputted as the display frame tone data in the LUT memory 36 and the data which is stored as the preceding frame tone data in the frame memory 34 into upper several bits (smaller than the bits of the original tone data) when tones indicated by their respective tone data are at or above a certain threshold value, or into lower several bits (smaller than the bits of the original tone data) when the tones are below this threshold value. The conversion of tone data in the LUT memory 36 is carried out according to tone data thus converted.

The following describes effects by the arrangement of the present embodiment, taking 8-bit tone data as an example. First, in order to describe the effects, the actual problem which is posed when the conversions by the LUT memory is replaced with calculations is defined. As described above, the object of the present invention is to correct the tone data so that display luminance after an elapsed time period of one frame substantially matches the target tone luminance. While this correction can be simply attained based on a charge model, it often requires optimization with respect to response characteristics of the liquid crystal molecules. We have studied this and found calculations which can take into account the influence of such characteristics of the liquid crystal molecules. However, it is not necessarily the case, depending on various conditions of different models of the device such as the liquid crystal mode or tone voltage, that optimum parameters used for the calculations are properly found. The LUT memory has versatility and degree of freedom which can always correct these uncertainties.

Incidentally, the Second Embodiment described the conversion method of tone data using only upper bits of the tone data. For example, using the upper 4 bits of 8-bit tone data, the tone conversion is carried out at every 16 tones. While this drastically reduces the memory size, it can be problematic in terms of display quality. That is, among 256 tones which the 8-bit tone data indicate, tones do not pose any serious problem in terms of display quality, for example, in an area of very bright tones such as tone 224 and tone 239, even when these tones are regarded as the same, but tones are clearly recognized as being different by the human visual characteristics, for example, in an area of dark tones such as tone 0 and tone 15. Thus, a failure to distinguish a difference of 16 tones in a dark area results in a significant loss in display quality even within one frame, which may be problematic.

For example, television images include dark moving images which are often found in movies, etc., and display of such television images on a liquid crystal display device, which has the foregoing problem of lowering display quality, may furnish the perception of the liquid crystal display devices as a display of poor quality. We have found that, depending on displayed scenes, a tone difference of two tones at most, i.e., omission of only the lowest 1 bit, is tolerable. While this may be the case, the foregoing problem is not so common in those types of displays such as lap-top personal computers which are designed to display balanced tones and data-oriented images. Thus, liquid crystal display devices which are used for these purposes tolerate the drastic measure of omitting the lower several bits as in the Second Embodiment.

FIG. 34 is a graph showing a relationship between tone and bit. When using only the upper 4 bits of the 8-bit tone data, the tone change from tone 0 to tone 255 and the tone change from tone 0 to tone 240 both use the same correction tone data which are converted based on preceding frame data with the upper 4 bits [0, 0, 0, 0] and display frame tone data with the upper 4 bits [1, 1, 1, 1]. Here, a luminance error which results from using the same correction tone data is, for example, about 10%. Meanwhile, the tone change from tone 255 to tone 31 and the tone change from tone 255 to tone 16 both use the same correction tone data which are converted based on preceding frame tone data with the upper 4 bits [1, 1, 1, 1] and display frame tone data with the upper 4 bits [0, 0, 0, 0]. Here, a luminance error which results from using the same correction tone data may become, for example, 70% or higher. A liquid crystal display device with an error this high may be useless in some cases.

Note that, tone luminance is generally set to $\gamma 2.2$. That is, luminance is set to be proportional to the tone raised to the power of 2.2. Therefore, given a difference of the same tone numbers, the luminance change becomes larger toward darker areas. FIG. 43 is a graph showing a common relationship between tone and luminance. It can be seen from the graph that a luminance change at tone 240 with respect to the luminance at tone 255 is about 12.5%, whereas a luminance change at tone 16 with respect to the luminance at tone 31 is about 76%.

The present embodiment explains a structure intended to reduce memory capacity of the entire device while maintaining a tone difference in a dark tone area in particular as described above, without losing versatility or degree of freedom of conversion of tone data by the LUT memory.

Figure 35:
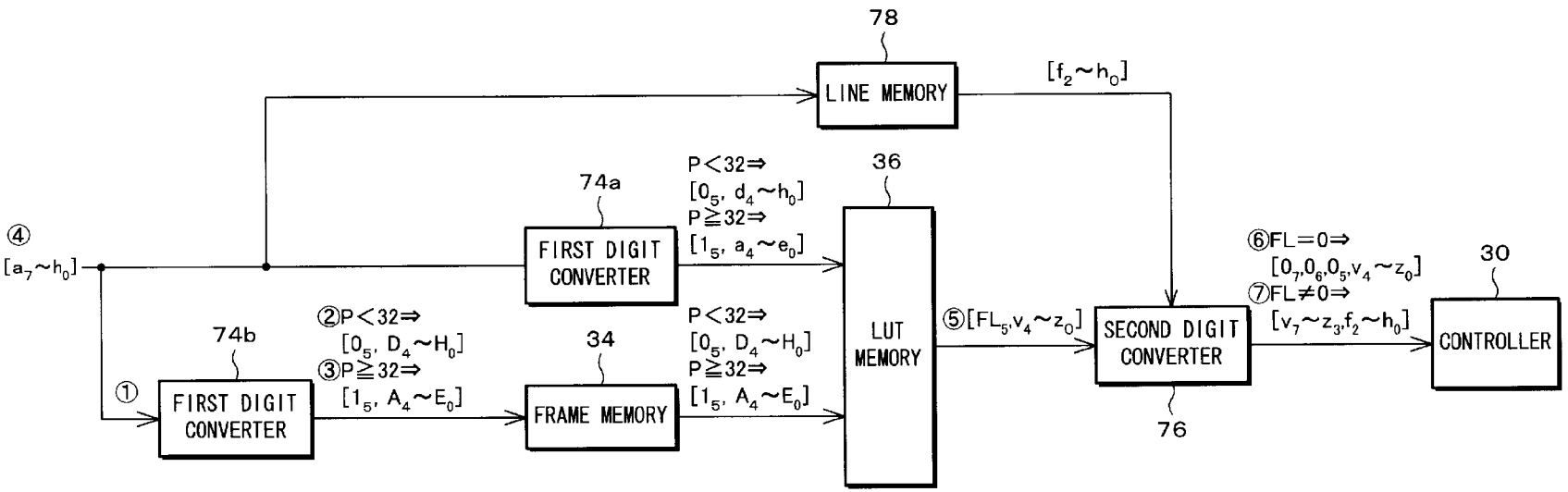
FIG. 35 is a block diagram showing a structure around an LUT memory according to the Seventh Embodiment of the present invention.

The structure of the active-matrix liquid crystal display device according to the present embodiment is basically the same as that described in the Second Embodiment based on FIG. 16, and only differences from the Second Embodiment are described here. As shown in FIG. 35, the active-matrix liquid crystal display device according to the present embodiment includes first digit converters 74*a* and 74*b* on the input sides of the tone data with respect to a first input of the LUT memory 36 and the frame memory 34, respectively, and a second digit converter 76 is provided between the LUT memory 36 and the controller 30. The display frame tone data is converted in the first digit converter 74*a* before inputted to the first input of the LUT memory 36, and predetermined lower several bits of the display frame tone data are sent to the second digit converter 76 via a line memory 78. The preceding frame tone data is converted in the first digit converter 74*b* and is temporarily stored in the frame memory 34 before inputted to a second input of the LUT memory 36. FIG. 35 is a block diagram showing a structure around the LUT memory according to the present embodiment.

Described below are denotations used in the present embodiment. Symbols in brackets [], such as a through h, A through H, and v through z indicate values (specifically, "0" or "1") of respective bits of tone data. Here, a through h of the small letters indicate tone data which are inputted as the display frame tone data to the LUT memory 36, and A through H of the capital letters indicate tone data which are inputted as the preceding frame tone data to the LUT memory 36. The symbol FL in brackets [] indicates the value (specifically "0" or "1") of the bit which is set as a flag. The subscripts beside the symbols or numbers in brackets indicate the place of bits of the symbols or numbers. For example, "$[0_5]$" indicates that the fifth bit of tone data is "0", and "$[a_7]$" indicates that the seventh bit of tone data is "a". Also, "P" indicates a tone indicated by tone data.

FIG. 36 and FIG. 37 are conceptual views showing contents of tone data in places indicated by ① through ⑦ in FIG. 35. The 8-bit tone data indicated by ① is inputted to the first digit converter 74*b* and is converted according to tone P which the tone data indicates. That is, the tone data is converted differently depending on whether tone P indicated by the tone data is at or above a predetermined reference tone, or below the predetermined reference tone. Note that, the 8-bit tone data indicated by ④ is inputted to the first digit converter 74*a* and is converted in the same manner as in the first digit converter 74*b*. The following explanation will mainly focus on the first digit converter 74*b*.

The predetermined tone is, for example, tone 32, and areas below tone 32 are dark areas where the problem of lowering display quality is posed when lower bits are omitted in conversion of the tone data. Note that, whether or not tone P is below tone 32 can be found depending on whether $[A_7, B_6, C_5]=[0_7, 0_6, 0_5]$.

The first digit converter 74*b* carries out the following processes. When tone P is below tone 32, the upper two bits, i.e., the seventh and sixth bits $[A_7, B_6]$ are deleted, and the tone P below tone 32 is indicated by indicating the fifth bit by $[0_5]$, using the fifth bit as a flag. By this conversion, the tone data becomes as shown by ②. The tone data ② after this conversion is reduced to 6 bits from the original 8 bits, but maintains all the information of the original tone data.

On the other hand, when tone P is at or above tone 32, the tone data is shifted by 3 bits toward the lower bits so as to delete the lower 3 bits, i.e., the second through zeroth bits $[F_2, G_1, H_0]$, and the tone P at or above tone 32 is indicated by indicating the fifth bit by $[1_5]$, using the fifth bit as a flag. By this conversion the tone data becomes as shown by ③. The tone data ③ after this conversion is reduced to 6 bits from the original 8 bits and is stored at the 8-tone intervals with the deletion of information of the lower 3 bits. Here, these lower 3 bits are considered not to have a significant influence on conversion of tone data in areas at or above tone 32.

The tone data converted by the first digit converter 74*b* is delayed by one frame period by the frame memory 34 and inputted as the preceding frame tone data into the LUT memory 36.

Further, the tone data as the display frame tone data is reduced to 6 bits from 8 bits by the first digit converter 74*a* in the described manner and is inputted to the LUT memory 36. Note that, the lower 3 bits of the display frame tone data, i.e., the second to zeroth bits $[f_2, g_1, h_0]$ are inputted to the line memory 78.

FIG. 38 is a conceptual view showing the number of input and output bits of the LUT memory 36. As described, the LUT memory 36 has inputs of 6 bits as the preceding frame tone data and inputs of 6 bits as the display frame tone data. Further, in the LUT memory 36, tone data of 6 bits is set as defined tone data which is specified by these inputs, and the LUT memory 36 has the outputs of 6 bits.

The defined tone data set in the LUT memory 36 is as shown by ⑤ in FIG. 37. Here, the fifth bit has $[FL_5]$, which is a flag, indicating whether the defined tone data, i.e., the tones which indicate the fourth to zeroth bits $[v_4, w_3, x_2, y_1, z_0]$ are below tone 32, or at or above tone 32. In this example, when FL=0, the tone indicated by the defined tone data is below tone 32, and when FL≠0 (FL=1), the tone indicated by the defined tone data is at or above tone 32.

The defined tone data outputted from the LUT memory 36 is inputted to the second digit converter 76. The second digit converter 76 performs digit conversion according to values of FL, which is a defined flag for the fifth bit of the inputted defined tone data. When FL=0 the defined tone data is below tone 32, and therefore the seventh to fifth bits are set to $[0_7, 0_6, 0_5]$, and are converted to correction tone data of 8 bits as shown by ⑥. When FL≠0 the defined tone data is at or above tone 32, and therefore the defined tone data ⑤ is shifted by 3 bits toward the upper bits, and the temporarily stored data $[f_2, g_1, h_0]$ in the line memory 78 are added as the values of the lower 3 bits, the second through zeroth bits, so as to convert the defined tone data to the correction tone data of 8 bits as shown by ⑦. The values of the lower 3 bits are added to obtain more stable still images with respect to areas of higher tones, and to complement the conversion by the 6-bit look-up table by the addition of information of the lower 3 bits of the display frame tone data. Thus, the line memory 78 or paths connected by the line memory 78 are provided to further improve display quality and may be omitted.

The correction tone data thus obtained by these conversions is sent to the controller 30.

The LUT memory 36, when tone P indicated by the display frame tone data (preceding frame tone data) is in a dark area, receives the lower 5 bits of the display frame tone data (preceding frame tone data) and a flag which indicates that the tone P is in a dark area, and when tone P is in a light area, receives the upper 5 bits of the display frame tone data (preceding frame tone data) and a flag which indicates that the tone P is in a light area. Thus, by setting suitable defined tone data based on these inputs in the LUT memory 36, suitable conversions are enabled.

According to this arrangement, the frame memory 34 stores tone data which indicate tones as they are when tone P indicated by the defined tone data is below tone 32, and stores tone data of every 8 tones when tone P indicated by the defined tone data is at or above tone 32. Also, the capacity of the frame memory 34 per pixel is 6 bits. Further, in the foregoing arrangement, the preceding frame tone data, the display frame tone data, and the output defined tone data of the LUT memory 36 are all 6 bits as shown in FIG. 38, and thus the capacity of the LUT memory 36 per pixel is 6+6+6=18 bits. This contrasts to the arrangement of the First Embodiment (FIG. 1) in which the capacity of the frame memory 34 per pixel is 8 bits, and the capacity of the LUT memory 32 per pixel is 8+8+8=24 bits. Thus, with the arrangement of the present embodiment, the capacity of the LUT memory 36 can be reduced by 1/64 of that in the arrangement of the First Embodiment. Note that, the capacity of the frame memory 34 can be reduced by 1/4.

Further, depending on use of the liquid crystal display device, there are cases where the accuracy of 1/256 tone is not required but sufficient accuracy should be ensured up to about tone 64. Provided that it is not necessary to take into consideration conversion of the respective lowest 1 bits of the display frame tone data and the preceding frame tone data by the LUT memory 36 below tone 64, the display frame tone data and the preceding frame tone data may be inputted to the LUT memory 36 at 2-tone intervals below tone 64 and at 8-tone intervals at or above tone 64. In this case, ②' in FIG. 39 is adopted instead of ② in FIG. 36. Whether or not tone P is less than tone 64 can be judged based on whether $[A_7, B_6]=[0_7, 0_6]$. When tone P is less than tone 64, the upper 2 bits, i.e., the seventh and sixth bits $[A_7, B_6]$ are deleted, and the remaining 6 bits are shifted by 1 bit toward the lower bits so as to delete the zeroth bit $[H_0]$. Further, using the fifth bit as a flag, the fifth bit is indicated by $[0_5]$, so as to indicate that tone P is smaller than tone 64.

In this case, in order to obtain a stable still image, it is also preferable to temporarily store the lower 3 bits $[f_2, g_1, h_0]$ in areas of lighter tones and the lowest 1 bit $[h_0]$ in areas of darker tones in the line memory 78 or other memories, and to add these data to the defined tone data in the second digit converter 76. This also enables reducing memory space as above.

As described, in the present embodiment, the LUT memory 36 and the second digit converter 76 which make up the converter convert the display frame tone data into correction tone data based on the display frame tone data and the preceding frame tone data. Also, the first digit converters 74*a* and 74*b* which make up the digit converter convert digits of display frame tone data and preceding frame tone data. The conversions by the first digit converters 74*a* and 74*b* are to reduce the number of bits (digits) of tone data (display frame tone data, preceding frame tone data) by deleting lower bits (lower digits) of the tone data when tones indicated by the tone data are brighter than a predetermined threshold value, i.e., tones which correspond to high luminance, and by deleting upper bits (upper digits) of the tone data when tones indicated by the tone data are darker than the predetermined threshold value, i.e., tones which correspond to low luminance. Further, the converter stores beforehand defined tone data which are specified by the display frame tone data and the preceding frame tone data which were converted by the first digit converters 74*a* and 74*b*, respectively, and generates correction tone data based on the defined tone data thus specified.

According to this arrangement, the memory space of the LUT memory 36 which is designated to store the defined tone data can be reduced. Further, the number of bits can be made smaller while maintaining those parts of tone data which are to have a large influence on the conversion by the LUT memory 36, thus preventing degradation of display quality.

Further, it is preferable that the tone data inputted to the present liquid crystal display device is inputted to the first input of the LUT memory 36 via the first digit converter 74*a*, and also to the frame memory 34 via the first digit converter 74*b* and onto the second input of the LUT memory 36 from the frame memory 34. According to this arrangement, the tone data inputted to the frame memory 34 is the tone data which was converted by the first digit converters 74*a* and 74*b* to have smaller numbers of bits. Thus, the memory space of the frame memory 34 can also be reduced. However, it is possible alternatively to input the tone data to the first digit converter 74*b* via the frame memory 34, and to the second input of the LUT memory 36 from the first digit converter 74*b*.

In conversion of the tone data by the first digit converters 74*a* and 74*b* which delete lower bits or upper bits of the tone data to reduce the number of bits of the tone data, a flag (flag bit) which indicates whether bits deleted are the lower bits or the upper bits is set for the converted tone data. In the LUT memory 36, pre-stored defined tone data is specified based on the remaining bits which were not deleted by the first digit converters 74*a* and 74*b*, and also based on the flag which was set in the foregoing manner. The defined tone data has the number of bits which corresponds to the number of bits (5 bits) which is obtained by excluding the flag bit from the number of bits (6 bits) of the tone data inputted to the LUT memory 36. Also, the defined tone data includes data $([v_4, w_3, x_2, y_1, z_0])$ which indicate tones in the correction tone data, and a flag (flag bit) (FL) which indicates whether the data indicating tones correspond to lower bits or upper bits of the correction tone data. The second digit converter 76, based on the flag, modifies the tone indicating part of the defined tone data as required, for example, by shifting, so as to set bits which correspond to the correction tone data, and to re-store the original number of bits of the tone data by filling the remaining bits with a predetermined value, for example, "0". Here, when the remaining bits so filled are lower bits of the correction tone data, the lower bits of the display frame tone data may be used.

Note that, generally, the tone data can be indicated by smaller values, i.e., only by lower bits, as the tones indicated by the tone data become darker, and can be indicated by larger values, i.e., by upper bits, as the tones become lighter.

The present embodiment described the case where two converters, the first digit converters 74*a* and 74*b*, are provided to make up the digit converter. However, only a single first digit converter may be provided to make up the digit converter, and the output of this first digit converter is inputted to the first input of the LUT memory 36 and the input of the frame memory 34.

As described, the liquid crystal display device of the present embodiment carries out tone display with pixels by applying a tone voltage according to tone data to each pixel in each frame, and includes: a converter for converting tone data of a display frame to correction tone data based on the tone data of the display frame and tone data of an immediately preceding frame; a digit converter for converting digits of the tone data of the display frame and the tone data of the immediately preceding frame; a driver for applying the tone voltage to the pixels based on the correction tone data obtained in the converter; and a liquid crystal cell, which makes up the pixels, for realizing tone display by the applied tone voltage, wherein: the converter carries out the conversion to decrease digits of tone data by deleting lower digits of the tone data when tones indicated by the tone data are on a lighter side of a predetermined threshold value, and by deleting upper digits of the tone data when tones indicated by the tone data is on a darker side of the predetermined threshold value, and the converter stores beforehand defined tone data which is specified by the tone data of the display frame and the tone data of the immediately preceding frame after the conversion by the digit converter, and generates the correction tone data based on the specified defined tone data.

The converter converts the tone data of the display frame to reduce a mismatch between tone data and the actual tone displayed on the liquid crystal cell due to a change in electric capacitance of the liquid crystal cell of a pixel caused by a change in tone voltage applied to this pixel. Specifically, when the tone indicated by the tone data of the display frame is higher than the tone indicated by the tone data of the immediately preceding frame, the converter converts the tone data of the display frame so as to increase the tone indicated by the tone data of the display frame, and when the tone indicated by the tone data of the display frame is lower than the tone indicated by the tone data of the immediately preceding frame, the converter converts the tone data of the display frame so as to reduce the tone indicated by the tone data of the display frame.

It is preferable in the liquid crystal display device of the present embodiment, in the liquid crystal display device having the converter, that the converter includes a first input and a second input, and the second input is connected to a memory section which stores inputted tone data and outputs the stored tone data after delaying it by one frame period, and the tone data is inputted to the first input via the digit converter, and also to the memory section via the digit converter and onto the second input from the memory section.

According to this arrangement, as described, the tone data of the display frame and the tone data of the immediately preceding frame can easily inputted to the converter with a simple structure. The memory section receives tone data which was converted by the digit converter to have smaller digits, thus reducing memory space of the memory section as well.

In the liquid crystal display device with the digit converter, it is preferable that the tone data comprises tone data of 256 tones, and when the darkest tone which the tone data indicates is tone 0, the threshold value is tone 32. Here, the tone data is 8-bit tone data, and the digit converter deletes upper 3 digits or lower 3 digits of the tone data in conversion of the tone data, and sets a flag bit which indicates whether digits deleted are upper digits or lower digits.

Alternatively, in the liquid crystal display device with the digit converter, the tone data may comprise tone data of 256 tones, and when the darkest tone which the tone data indicates is tone 0, the threshold value is tone 64. Here, the tone data is 8-bit tone data, and the digit converter deletes upper 2 digits or lower 3 digits of the tone data in conversion of the tone data, and sets a flag bit which indicates whether digits deleted are upper digits or lower digits, and further deletes the lowest digit when digits deleted are the upper 2 digits.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A liquid crystal display device which carries out tone display with pixels by applying a tone voltage according to tone data to each pixel in each frame, comprising:

a converter for converting tone data of a display frame to correction tone data based on the tone data of the display frame and tone data of an immediately preceding frame;

a driver for applying the tone voltage to the pixels based on the correction tone data obtained in said converter;

a liquid crystal cell, which makes up the pixels, for realizing tone display by the applied tone voltage, wherein said converter stores beforehand defined tone data which is specified by the tone data of the display frame and the tone data of the immediately preceding frame, and said converter generates the correction tone data based on the specified defined tone data;

wherein said converter specifies the defined tone data based on upper digits of the tone data of the display frame and upper digits of the tone data of the immediately preceding frame, said converter converting the tone data of the display frame by replacing the upper digits of the tone data of the display frame with the specified defined tone data, and generating the correction tone data base on a result of conversion; and wherein said converter converts the upper digits of the tone data of the display frame based on the upper digits of the tone data of the display frame and the upper digits of the tone data of the immediately preceding frame, and converts lower digits of the tone data of the display frame based on the lower digits of the tone data of the display frame and lower digits of the tone data of the immediately preceding frame, and generates the correction tone data by adding the converted upper digits and the converted lower digits of the tone data of the display frame.

2. The liquid crystal display device as set forth in claim 1, wherein said converter carries out the conversion to increase values of the lower digits of the tone data of the display frame when the values of the lower digits of the tone data of the display frame are larger than values of the lower digits of the tone data of the immediately preceding frame, and to decrease the values of the lower digits of the tone data of the display frame when the values of the lower digits of the tone data of the display frame are smaller than values of the lower digits of the one data of the immediately preceding frame.

3. The liquid crystal display device as set forth in claim 1, wherein said converter converts the lower digits of the tone data of the display frame by adding (a) constant multiples of a difference between the lower digits of the tone data of the display frame and the lower digits of the tone data of the immediately preceding frame to (b) the lower digits of the tone data of the display frame.

4. A liquid crystal display device which carries out one display with pixels by applying a tone voltage according to tone data to each pixel in each frame, comprising:

a converter for converting tone data of a display frame to correction tone data based on the tone data of the display frame and tone data of an immediately preceding frame;

a digit converter for converting digits of the tone data of the display frame and the tone data of the immediately preceding frame;

a driver for applying the tone voltage to the pixels based on the correction tone data obtained in said converter; and a liquid crystal cell, which makes up the pixels, for realizing tone display by the applied tone voltage, wherein:

said digit converter carries out the conversion to decrease digits of tone data by deleting lower digits of the tone data when tones indicated by the tone data are on a lighter side of a predetermined threshold value, and by deleting upper digits of the tone data when tones indicated by the tone data is on a darker side of the predetermined threshold value, and said converter stores beforehand defined tone data which is specified by the tone data of the display frame and the tone data of the immediately preceding frame after the conversion by said digit converter, and generates the correction tone data based on the specified defined tone data.

5. The liquid crystal display device as set forth in claim 4, wherein:

said converter includes a first input and a second input, the second input being connected to a memory section which stores inputted tone data and outputs the stored tone data after delaying it by one frame period, and the tone data being inputted to the first input via said digit converter, and also to the memory section via said digit converter and onto the second input from the memory section.

6. The liquid crystal display device as set forth in claim 4, wherein the tone data comprises tone data of 256 tones, and when the darkest tone which the tone data indicates is tone 0, said threshold value is tone 32.

7. The liquid crystal display device as set forth in claim 6, wherein:

the tone data is 8-bit tone data, and said digit converter deletes upper 3 digits or lower 3 digits of the tone data in conversion of the tone data, and sets a flag bit which indicates whether digits deleted are upper digits or lower digits.

8. The liquid crystal display device as set forth in claim 4, wherein the tone data comprises tone data of 256 tones, and when the darkest tone which the tone data indicates is tone 0, said threshold value is tone 64.

9. The liquid crystal display device as set forth in claim 8, wherein:

the tone data is 8-bit tone data, and said digit converter deletes upper 2 digits or lower 3 digits of the tone data in conversion of the tone data, and sets a flag bit which indicates whether digits deleted are upper digits or lower digits, and further deletes the lowest digit when digits deleted are the upper 2 digits.

10. A driving method of a liquid crystal display device which carries out tone display with pixels including a liquid crystal cell capable of tone display by an applied tone voltage, said liquid crystal display device realizing one display by applying a tone voltage according to tone data to each pixel in each frame, said method comprising the steps of:

converting digits of tone data of a display frame and tone data of an immediately preceding frame;

specifying single defined tone data from a pre-stored group of defined tone data according to the tone data of the display frame and the tone data of the immediately preceding frame after the digit conversion; and applying a tone voltage based on the specified defined tone data to the pixels so as to realize tone display in the display frame, wherein the digit conversion of the tone data of the display frame and the tone data of the immediately preceding frame is carried out to decrease digits of the tone data by deleting lower digits of the tone data when tones indicated by the tone data are on a lighter side of a predetermined threshold value, and by deleting upper digits of the tone data when tones indicated by the tone data is on a darker side of the predetermined threshold value.

* * * * *